US009241220B2

(12) United States Patent
Umetsu et al.

(10) Patent No.: US 9,241,220 B2
(45) Date of Patent: Jan. 19, 2016

(54) SPEAKER DEVICE

(75) Inventors: Yasumi Umetsu, Tendo (JP); Minoru Horigome, Tendo (JP)

(73) Assignees: Pioneer Corporation, Kanagawa (JP); Tohoku Pioneer Corporation, Yamagata (JP)

( * ) Notice: Subject to any disclaimer, the term of this patent is extended or adjusted under 35 U.S.C. 154(b) by 1137 days.

(21) Appl. No.: 12/677,057

(22) PCT Filed: Oct. 14, 2008

(86) PCT No.: PCT/JP2008/068580

§ 371 (c)(1),
(2), (4) Date: Mar. 8, 2010

(87) PCT Pub. No.: WO2010/044136

PCT Pub. Date: Apr. 22, 2010

(65) Prior Publication Data

US 2011/0116650 A1 May 19, 2011

(51) Int. Cl.

| | |
|---|---|
| ***H04R 1/00*** | (2006.01) |
| ***H04B 1/00*** | (2006.01) |
| ***H04R 9/04*** | (2006.01) |

(Continued)

(52) U.S. Cl.

CPC *H04R 9/045* (2013.01); *H04R 7/16* (2013.01); *H04R 9/025* (2013.01); *H04R 2499/11* (2013.01); *H04R 2499/13* (2013.01); *H04R 2499/15* (2013.01)

(58) Field of Classification Search

CPC ..... H04R 9/045; H04R 7/16
USPC ..... 381/182, 186, 86, 412, 398; 181/157, 181/163

See application file for complete search history.

(56) References Cited

U.S. PATENT DOCUMENTS

| | | | | |
|---|---|---|---|---|
| 6,343,128 | B1 * | 1/2002 | Coffin | 381/186 |
| 6,678,384 | B2 * | 1/2004 | Kowaki et al. | 381/182 |

(Continued)

FOREIGN PATENT DOCUMENTS

| | | |
|---|---|---|
| JP | 62-073898 A | 4/1987 |
| JP | 8-149596 | 6/1996 |

(Continued)

OTHER PUBLICATIONS

International Preliminary Report for Application No. PCT/JP2008/068580 issued Jun. 7, 2011 (1 page).

(Continued)

*Primary Examiner* — Duc Nguyen
*Assistant Examiner* — Phan Le
(74) *Attorney, Agent, or Firm* — Osha Liang LLP

(57) ABSTRACT

A speaker device includes a diaphragm, a frame supporting the diaphragm vibratably along a vibration direction, and a driving part disposed in proximity of the frame and vibrating the diaphragm corresponding to an audio signal. The driving part includes a magnetic circuit having a magnetic gap formed along a direction different from the vibration direction of the diaphragm, a voice coil supporting part having a voice coil and vibrating along the magnetic gap, and a vibration-direction-conversion part direction-converting the vibration of the voice coil supporting part and transmitting the vibration to the diaphragm. The vibration-direction-conversion part includes a link body angle-converting a link part formed between the voice coil supporting part and the diaphragm.

41 Claims, 18 Drawing Sheets

(51) Int. Cl.
*H04R 7/16* (2006.01)
*H04R 9/02* (2006.01)

(56) References Cited

U.S. PATENT DOCUMENTS

| | | | | |
|---|---|---|---|---|
| 2002/0093881 | A1* | 7/2002 | Kane | 367/149 |
| 2003/0095678 | A1 | 5/2003 | Hooley et al. | |
| 2005/0157905 | A1 | 7/2005 | Beer et al. | |
| 2005/0279566 | A1* | 12/2005 | Hooley et al. | 181/163 |
| 2006/0245614 | A1* | 11/2006 | Ishikawa | 381/397 |
| 2007/0165887 | A1* | 7/2007 | Shin et al. | 381/152 |
| 2008/0056515 | A1* | 3/2008 | Hama | 381/191 |
| 2009/0316948 | A1* | 12/2009 | Kaiya | 381/398 |
| 2011/0232990 | A1* | 9/2011 | Kobayashi et al. | 181/157 |

FOREIGN PATENT DOCUMENTS

JP 2005-159409 A 6/2005
WO 2010-044136 A1 4/2010

OTHER PUBLICATIONS

Written Opinion for Application No. PCT/JP2008/068580 mailed Nov. 11, 2008, with English translation thereof (6 pages).

espacenet, Patent Abstract for Japanese Publication No. 2005-159409 Published Jun. 16, 2005 (1 page).

espacenet, Patent Abstract for Japanese Publication No. 62-073898 Published Apr. 4, 1987 (1 page).

International Search Report for Application No. PCT/JP2008/068580 mailed Nov. 11, 2008, with English translation thereof (2 pages).

Patent Abstracts of Japan for patent application with Publication No. 08-149596, Publication Date: Jun. 7, 1996, 1 page.

Extended European Search Report issued in corresponding European Application No. 08876855.1 dated Oct. 26, 2012 (4 pages).

* cited by examiner

Prior Art (a)

SPEAKER DEVICE

FIELD OF THE INVENTION

The invention relates to a speaker device.

BACKGROUND ART

As a general speaker device, a dynamic speaker device as disclosed, for example, in Japanese publication of patent application No. Hei 8-149596 is known. For example, as shown in FIG. 1, the dynamic speaker device described in this publication includes a frame 3J, a cone-shaped diaphragm 21J, an edge 4J which supports the diaphragm 21J to the frame 3J, a voice coil bobbin 610J joined to the inner periphery of the diaphragm 21J, a damper 7J which supports the voice coil bobbin 610J to the frame 3J, a voice coil 611J wound around the voice coil bobbin 610J, a yoke 51J, a magnet 52J, a plate 53J, and a magnetic circuit having a magnetic gap in which the voice coil 611J is arranged. In this speaker device, when an audio signal is inputted to the voice coil 611J, the voice coil bobbin 610J vibrates by the Lorentz force developed in the voice coil 611J in the magnetic gap and the diaphragm 21J is driven by the vibration.

DISCLOSURE OF THE INVENTION

The general dynamic speaker device described above is, for example as shown in FIG. 1, configured such that the voice coil 611J is disposed opposite to the sound emission side of the diaphragm 21J, and the vibration direction of the voice coil 611J and the voice coil bobbin 610J is the same as the vibration direction of the diaphragm 21J. In such a speaker device, a region for vibration of the diaphragm 2J, a region for vibration of the voice coil bobbin 610J, and a region for arranging the magnetic circuit, etc. are formed along the vibration direction (sound emission direction) of the diaphragm 21J. Accordingly, the total height of the speaker device inevitably becomes comparatively large.

Specifically, as shown in FIG. 1, the dimension of the speaker device along the vibration direction of the diaphragm 21J is defined by: (a) the height of the cone-shaped diaphragm 21J along the vibration direction plus the total height of the edge 4J which supports the diaphragm 21J to the frame 3J, (b) the height of the voice coil bobbin from the junction of the diaphragm 21J and the voice coil bobbin 610J to the upper end of the voice coil 611J, (c) the height of the voice coil, (d) the height mainly of the magnet of the magnetic circuit, and (e) the thickness mainly of the yoke 51J of the magnetic circuit, etc. The speaker device as described above requires sufficient heights of the above-mentioned (a), (b), (c), and (d) to ensure a sufficient vibration stroke of the diaphragm 21J. Further, the speaker device requires sufficient heights of the above-mentioned (c), (d), and (e) to obtain a sufficient driving force. Accordingly, particularly in a speaker device for large volume, the total height of the speaker device inevitably becomes large.

Since the vibration direction of the voice coil bobbin 610J is the same direction as the vibration direction of the diaphragm 21J in conventional speaker devices as described above, the total height of the speaker devices inevitably becomes large to ensure the vibration stroke of the voice coil bobbin 610J, when seeking a large volume of sound by increasing the amplitude of the diaphragm 21J. Thus, it becomes difficult to make a device thin. In other words, making a device thin and securing a large volume of sound are contradictory.

Nevertheless, in order to efficiently transmit the vibration of the voice coil 611J to the diaphragm 21J, a direct transmission of the vibration from the voice coil 611J to the diaphragm 21J, i.e. the alignment of the vibration direction of the voice coil 611J and the vibration direction of the diaphragm 21J is preferable. In the case that the vibration direction of the voice coil 611J and the vibration direction of the diaphragm 21J are different, the vibration of the voice coil 611J may not be securely transmitted to the diaphragm 21J, which may cause deterioration of the reproduction efficiency of the speaker device. For example, in order to obtain a preferable reproduction characteristic in a high-tone range, it is necessary to securely transmit the vibration of the voice coil 611J to the diaphragm.

On the other hand, in the general dynamic speaker device, since the voice coil bobbin 610J is joined to an inner periphery of the cone-shaped diaphragm 21J and a driving force is transmitted from the voice coil bobbin 610J to the inner periphery of the diaphragm 21J, it is comparatively difficult to drive the entire diaphragm substantially in the same phase. Therefore, a speaker device allowing the entire diaphragm to vibrate substantially in the same phase is desired.

For example, a capacitor speaker device is known as a thin speaker device. The capacitor speaker device has such a structure that a diaphragm (movable electrode) and a fixed electrode are arranged opposite to each other. In this speaker device, the diaphragm is displaced by application of a DC voltage across the electrodes, and when a signal superimposed with an audio signal is inputted to the electrodes, the diaphragm vibrates in response to the signal. In this capacitor speaker device, however, if an audio signal with a comparatively large amplitude is inputted, a driving force may nonlinearly vary considerably and thereby the quality of reproduced sound may be comparatively lowered.

One or more embodiments of the present invention provide a thin speaker device capable of emitting a large volume of reproduced sound with a comparatively simple structure, to obtain a speaker device with a high reproduction efficiency capable of securely transmitting the vibration of the voice coil to the diaphragm, to obtain a speaker device suited for reproduction in a high-tone range, to provide a thin speaker device capable of emitting a high-quality reproduced sound with a comparatively simple structure, or to provide a thin speaker device capable of vibrating the diaphragm substantially in the same phase with a comparatively simple structure.

SUMMARY OF THE INVENTION

In general, a speaker device according to one aspect of the present invention includes a diaphragm, a frame supporting the diaphragm vibratably along a vibration direction, and a driving part disposed in proximity of the frame and vibrating the diaphragm corresponding to an audio signal. The driving part includes a magnetic circuit having a magnetic gap formed along a direction different from the vibration direction of the diaphragm, a voice coil supporting part having a voice coil and vibrating along the magnetic gap, and a vibration-direction-conversion part direction-converting the vibration of the voice coil supporting part and transmitting the vibration to the diaphragm. The vibration-direction-conversion part includes a link body angle-converting a link part formed between the voice coil supporting part and the diaphragm.

BRIEF DESCRIPTION OF THE DRAWINGS

FIG. 2(*a*) is a plan view of the speaker device and FIG. 2(*b*) is a sectional view of FIG. 2(*a*) taken along line A-A;

FIG. 6(*a*) is a view illustrating a state of the vibration-direction-conversion part when a diaphragm is displaced to a sound emission side with respect to a reference position, FIG. 6(*b*) is a view illustrating a state of the vibration-direction-conversion part when the diaphragm is placed at the reference position, and FIG. 6(*c*) is a view illustrating a state of the vibration-direction-conversion part when the diaphragm is displaced to the side opposite to the sound emission side with respect to the reference position;

FIG. 7(*b*) is a view illustrating a variation of the speaker device shown in FIG. 7(*b*);

FIG. 8(*a*) is a sectional view of the speaker device, and FIGS. 8(*b*) and 8(*c*) are views illustrating the hinge part between an outside link part and a frame;

FIG. 9(*a*) is a side view, and FIGS. 9(*b*) and 9(*c*) are plan views of the vibration-direction-conversion part;

FIG. 10(*a*) is a side view, FIG. 10(*b*) is a perspective view, and FIG. 10(*c*) is an exploded perspective view illustrating the link body;

FIG. 11(*b*) is a view illustrating a variation of the link body shown in FIG. 11(*a*);

DETAILED DESCRIPTION OF THE INVENTION

Figure 1:
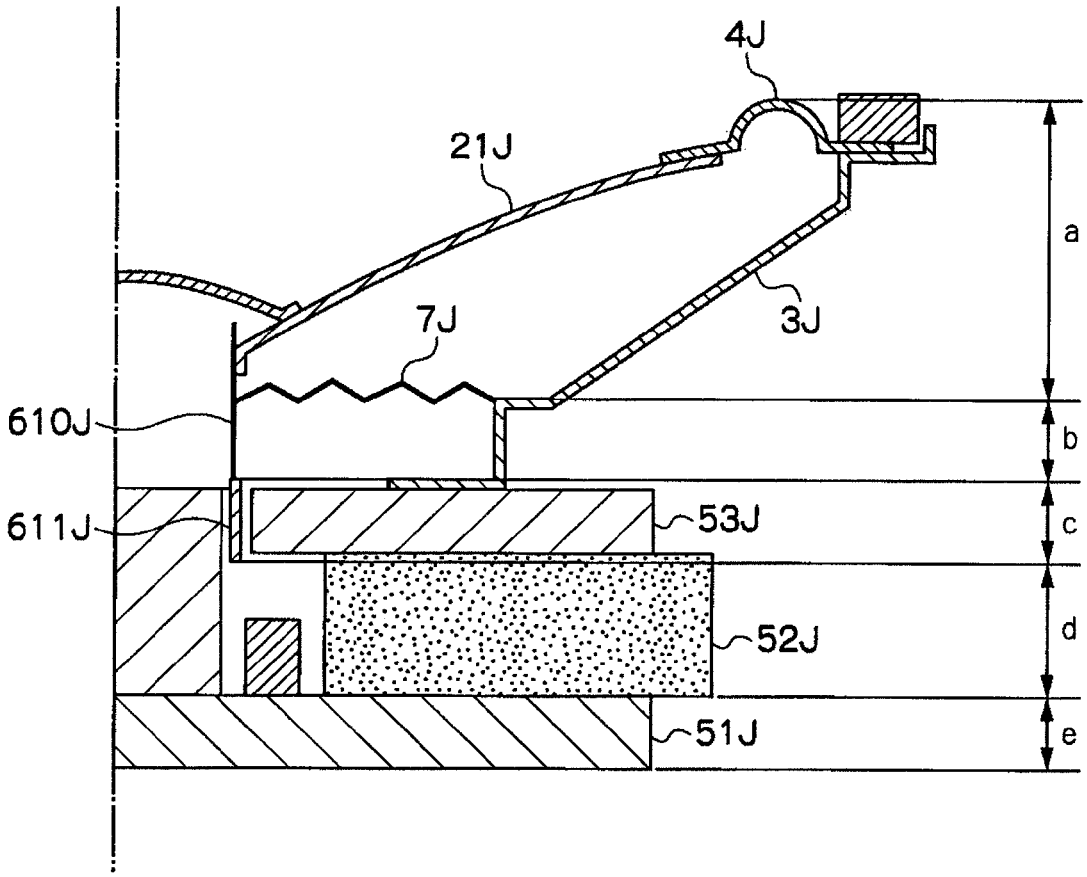
FIG. 1 is a view illustrating a speaker device of a prior art.

A speaker device according to one or more embodiments of the present invention includes a diaphragm, a frame supporting the diaphragm vibratably along a vibration direction, and a driving part disposed in proximity of the frame and vibrating the diaphragm corresponding to an audio signal. The driving part includes a magnetic circuit having a magnetic gap formed along a direction different from the vibration direction of the diaphragm, a voice coil supporting part having a voice coil and vibrating along the magnetic gap, and a vibration-direction-conversion part direction-converting the vibration of the voice coil supporting part and transmitting the vibration to the diaphragm. The vibration-direction-conversion part includes a link body angle-converting a link part formed between the voice coil supporting part and the diaphragm.

The link body angle-converts the link part upon receiving a reaction force applied to the link part from a stationary part disposed opposite to the diaphragm side. More specifically the stationary part is a part of the frame.

Further, the frame includes a planar bottom face, the diaphragm is planarly supported along the bottom face of the frame, the magnetic gap is formed along the bottom face of the frame, and the vibration-direction-conversion part vibrates the diaphragm in a direction of crossing the bottom face with the reaction force from the bottom face of the frame.

Further, the magnetic circuit includes a pair of the magnetic gaps generating mutually opposite magnetic fields, and the voice coil supporting part is planarly formed, and includes a voice coil annularly formed such that current flows in opposite directions in the pair of the magnetic gaps.

In the speaker device of the above configuration, when an audio signal is inputted to the voice coil of the driving part, the Lorentz force is developed in the voice coil arranged in the magnetic gap of the magnetic circuit, causing the voice coil supporting part to vibrate in a direction different from the vibration direction of the diaphragm, for example, in a direction perpendicular to the vibration direction of the diaphragm. The vibration-direction-conversion part then functions to convert the vibration direction of the voice coil supporting part and transmit the driving force to the diaphragm. The diaphragm vibrates in a vibration direction different from that of the voice coil supporting part (for example in a direction perpendicular to the vibration direction of the voice coil supporting part) by the driving force transmitted through the vibration-direction-conversion part.

In a general speaker device, for example, since a voice coil bobbin is arranged in the back side of a diaphragm such that the diaphragm and the voice coil bobbin are configured to vibrate in the similar direction, it is necessary to secure a space in which the diaphragm and the voice coil bobbin can vibrate in the vibration direction, which makes the width (total height) of the speaker device comparatively large in the sound emission direction.

On the contrary, the speaker device according to an embodiment of the present invention includes a magnetic circuit having a magnetic gap formed in a direction different from the vibration direction of the diaphragm, for example, in a direction perpendicular to the vibration direction of the diaphragm, the voice coil supporting part vibrating along the magnetic circuit, and the vibration-direction-conversion part converting the vibration direction of the voice coil supporting part and transmitting the driving force to the diaphragm, which makes the width of the speaker device comparatively small in the sound emission direction, compared to the above-mentioned general speaker device. This means that it is possible to provide a thin speaker device. In addition, since the vibration stroke of the voice coil supporting part may be configured in a direction that has little effect on the total height of the speaker device, it becomes possible to make a thin speaker device even when the vibration stroke, i.e. the amplitude of the diaphragm is made to be large. This enables both making a thin speaker device and securing a large volume of sound.

Further, since the vibration-direction-conversion part is formed by a link body for angle-converting a link part disposed between the voice coil supporting part and the diaphragm, the vibration of the voice coil supporting part can be mechanically and securely transmitted to the diaphragm. By configuring the link body such that the link part is angle-converted upon receiving a reaction force from the stationary part located on the opposite side to the diaphragm, and the vibration of the voice coil supporting part can be securely transmitted to the diaphragm in the course of receiving the reaction force from the stationary part, a high transmission efficiency may be obtained even when the vibration directions are different from each other between the voice coil supporting part and the diaphragm. Thus, a high reproduction efficiency of the speaker device can be obtained. In particular, a high-quality reproduction characteristic may be obtained in a high-tone range by securely transmitting the vibration of the voice coil to the diaphragm.

Further, in the speaker device according to the embodiment of the present invention, since the driving force developed in the voice coil is mechanically angle-converted and transmitted to the diaphragm through the vibration-direction-conversion part having a link body. Thus, the driving principle in itself is the same as dynamic speaker. Accordingly, it is possible to emit a comparatively high-quality reproduced sound relative to the above-mentioned capacitor speaker device when producing a large volume of sound.

Further, a speaker device adapted to, for example, transmit a driving force from a voice coil to a diaphragm by utilizing the bending of a flexible member has a problem that the flexible member tends to resonate (especially at low frequencies). Compared with the speaker device adapted to transmit a driving force from a voice coil to a diaphragm by utilizing the bending of a flexible member, the speaker device according to one embodiment of the present invention transmits the driving force from the voice coil to the diaphragm by a rigid link body. Thus, the diaphragm can be vibrated at a relatively high sensitivity, thereby hardly causing a reduction of response due to a distortion of the flexible member for example.

Further, in a specific configuration, the frame has a planar bottom face, the diaphragm is planarly supported along the bottom face of the frame, the magnetic gap is formed along the bottom face of the frame, and the vibration-direction-conversion part vibrates the diaphragm in a direction crossing the bottom face by a reaction force from the bottom face, being the above-mentioned stationary part. Therefore, the speaker device as a whole may be structured in a planar shape along the bottom face of the frame, and thereby the whole device can be made thin.

Further, in a specific structure of the driving part, the magnetic circuit has a pair of magnetic gaps developing magnetic fields in directions opposite to one another, and the voice coil supporting part is planarly formed to include a voice coil annularly formed such that current flows in opposite directions through the pair of magnetic gaps. Therefore, the planar voice coil supporting part can be planarly vibrated with a high driving force by using the pair of magnetic gaps and a straight-line vibration is made possible with little fluctuation by increasing planar rigidity of the voice coil supporting part. In particular, having the above-mentioned planar frame bottom face, a thin space on the frame bottom face can be used as a vibration space of the voice coil supporting part, thus a space in thickness direction can efficiently be saved.

The speaker device according to one or more embodiments of the present invention can be used for various devices such as mobile phones, in-vehicle speakers, speakers for personal computers, and speakers for television broadcasting receivers.

Hereinafter, a speaker device according to one or more embodiments of the present invention is described with reference to the drawings.

Figure 2:
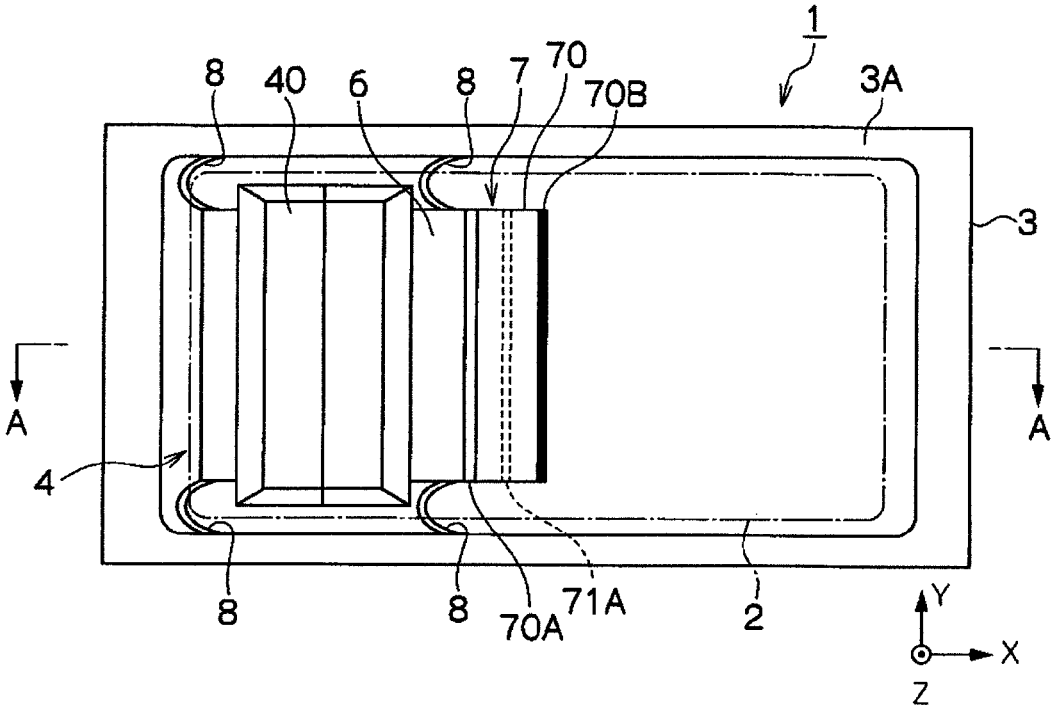
FIG. 2 is a view illustrating a basic configuration of the speaker device according to an embodiment of the present invention.
Figure 2:
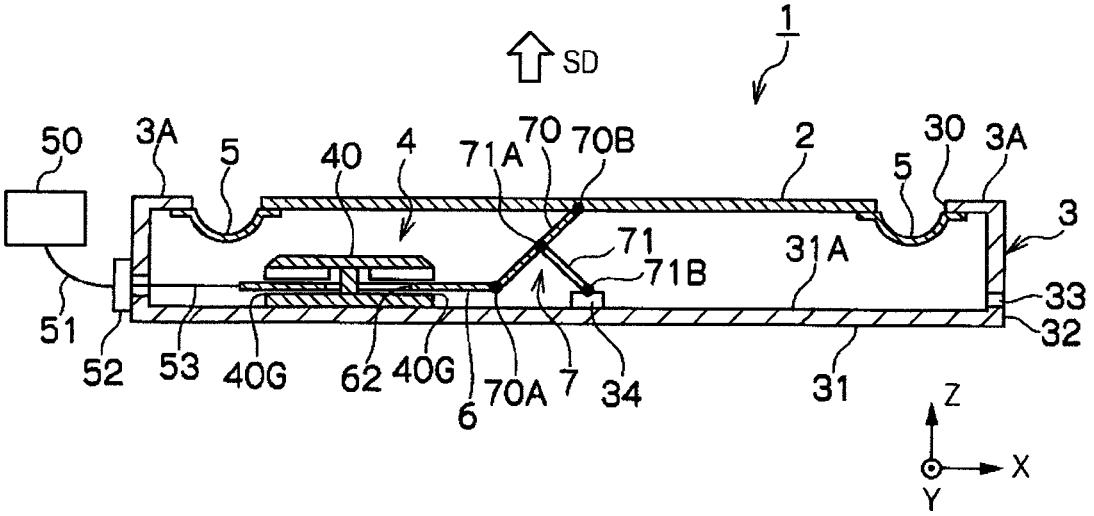
Figure 3:
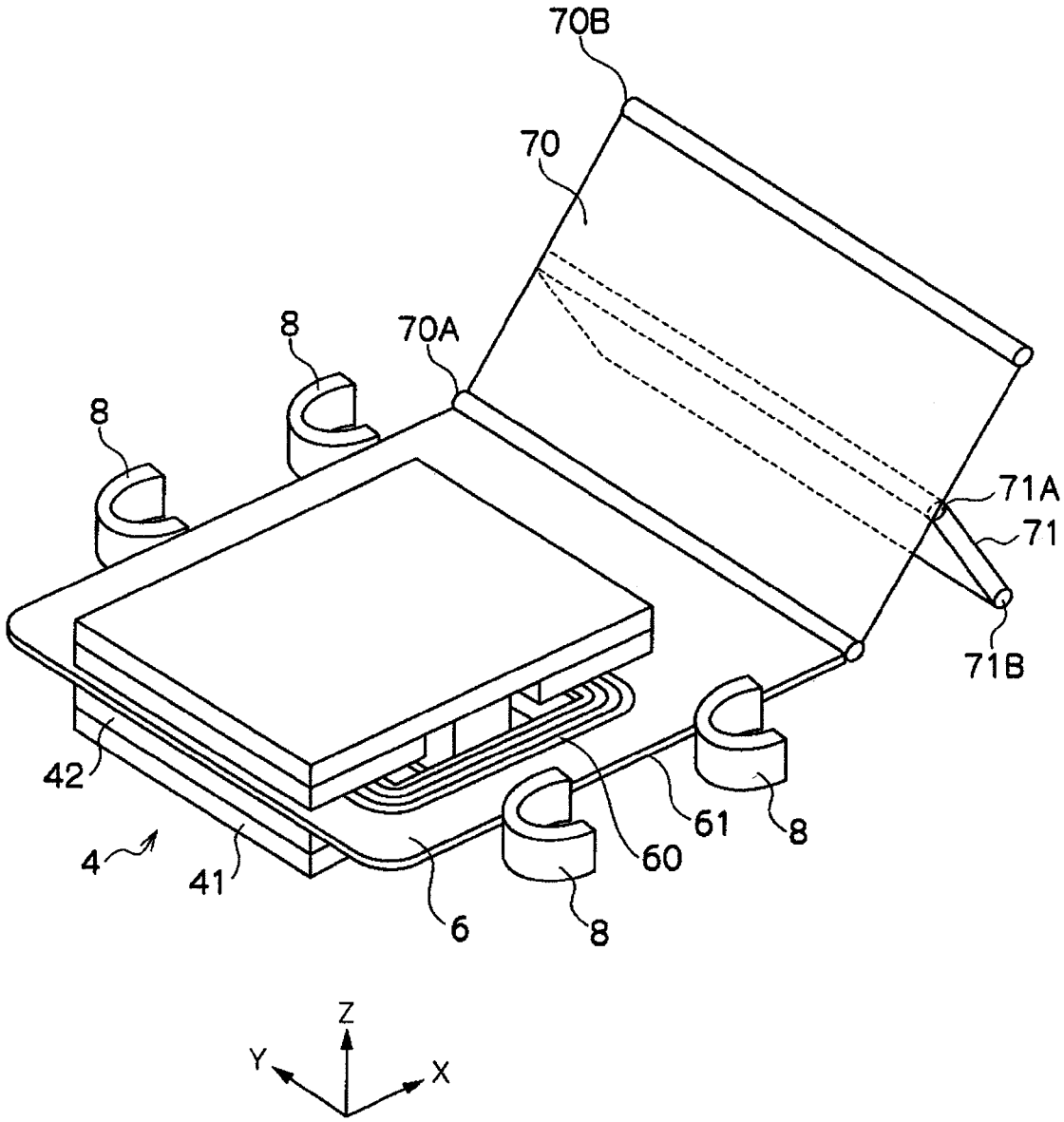
FIG. 3 is a view illustrating a basic configuration (driving part) of the speaker device according to an embodiment of the present invention.
Figure 4:
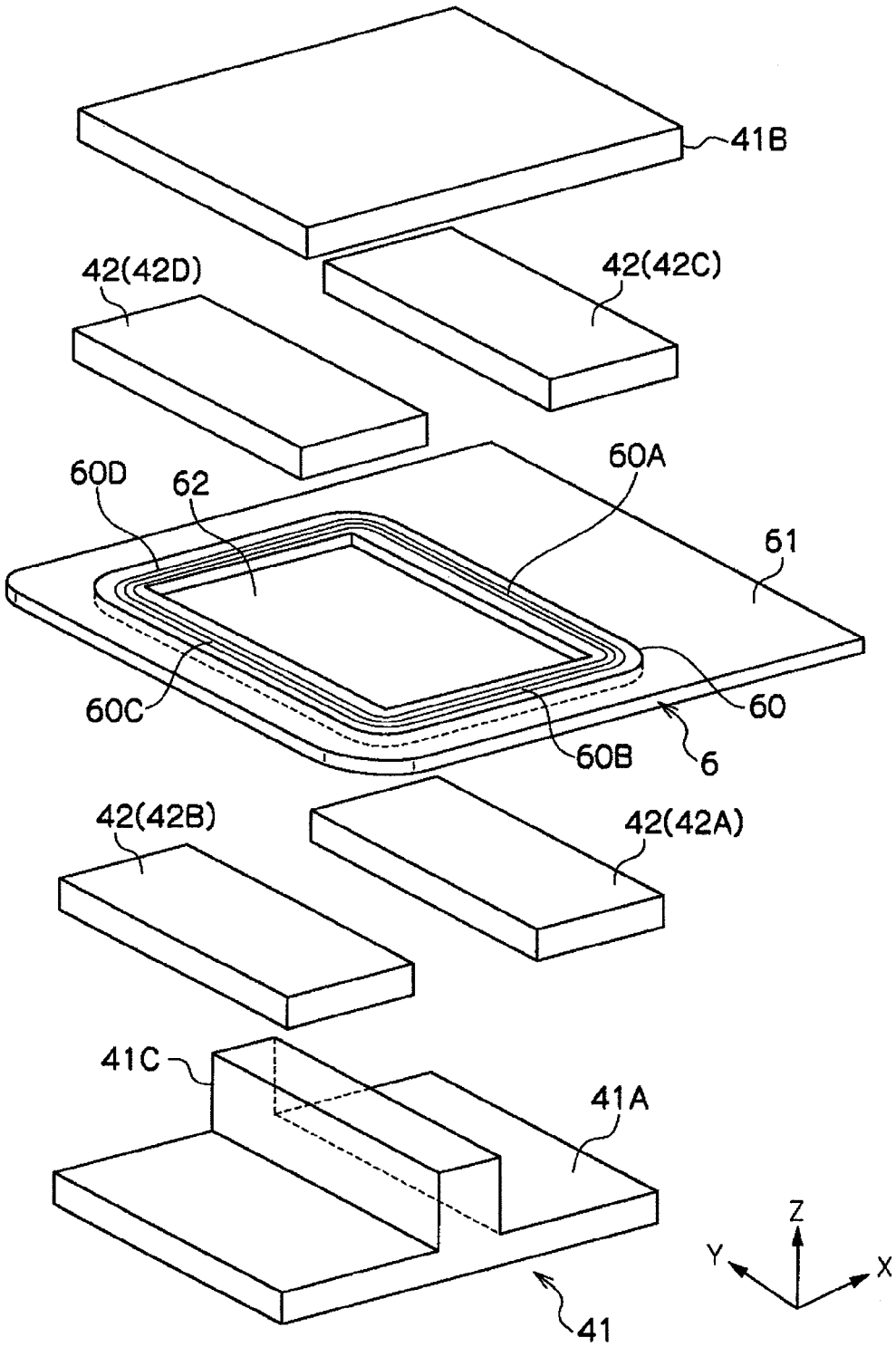
FIG. 4 is a view illustrating a basic configuration (driving part) of the speaker device according to an embodiment of the present invention.
Figure 5:
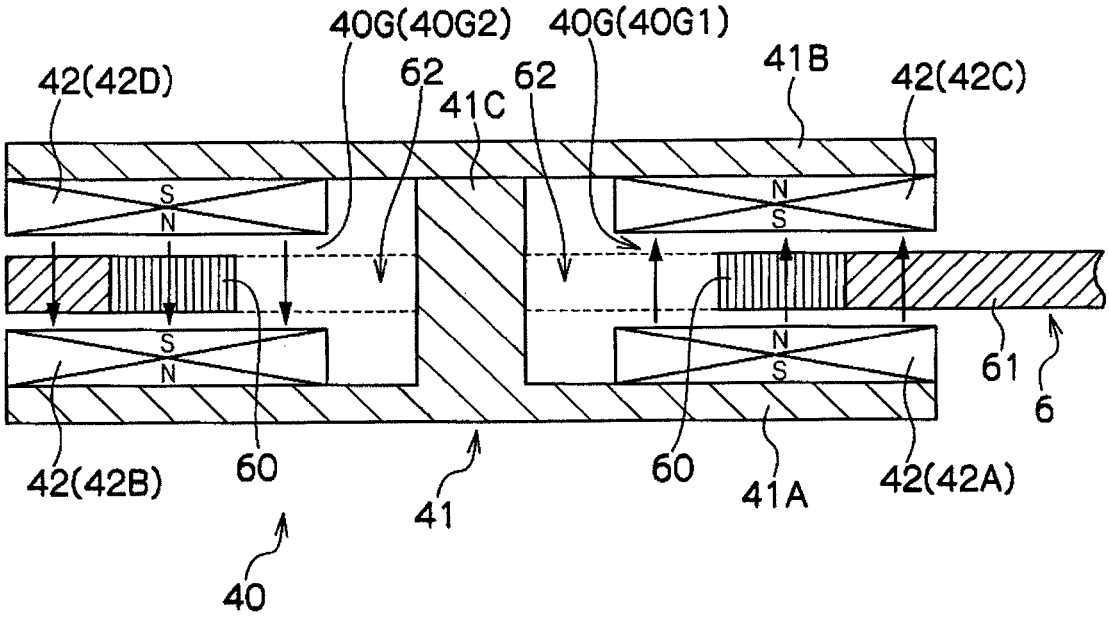
FIG. 5 is a view illustrating a basic configuration (driving part) of the speaker device according to an embodiment of the present invention.
Figure 6:
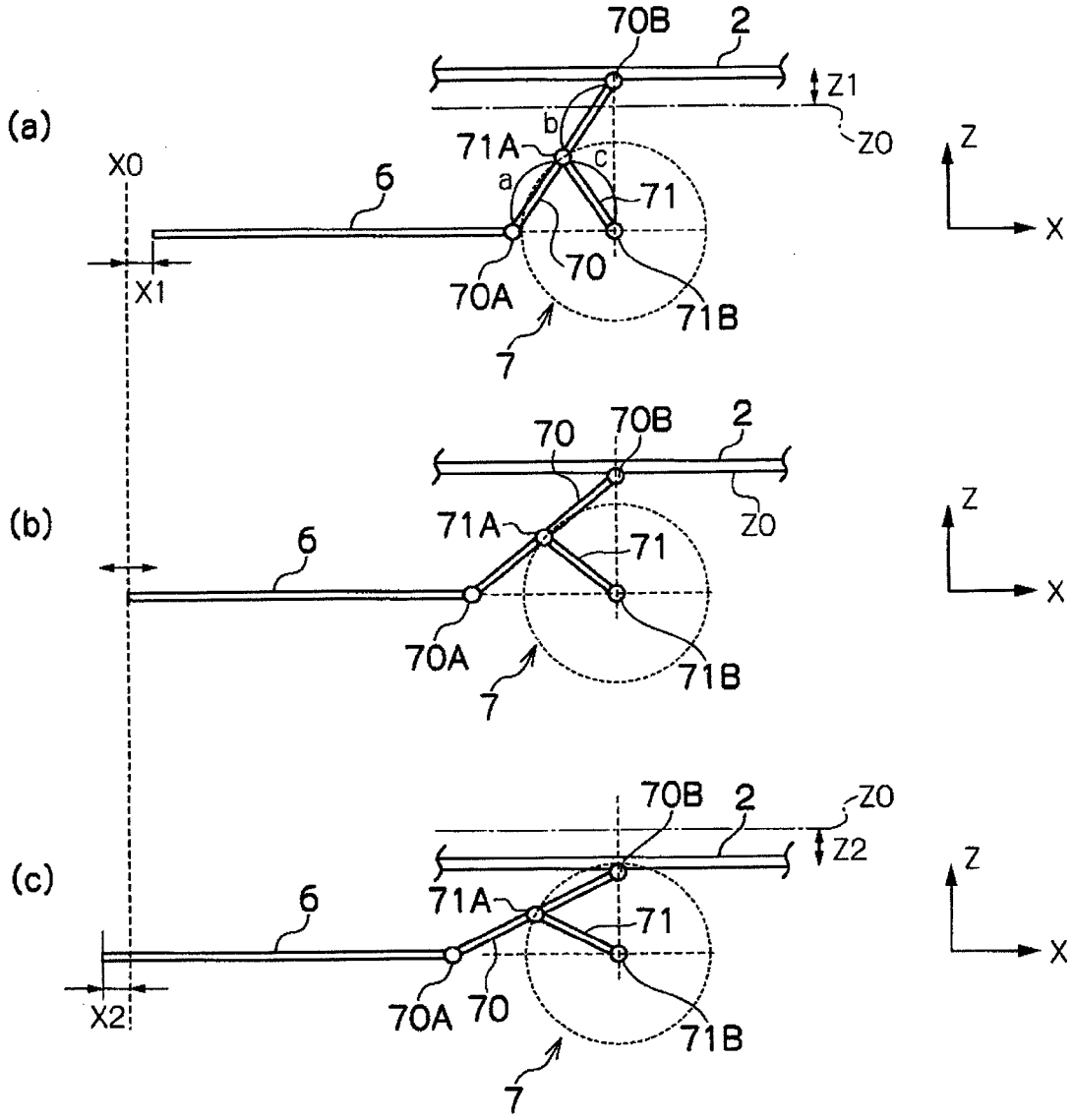
FIG. 6 is a view illustrating a basic configuration (operation of the vibration-direction-conversion part) of the speaker device according to an embodiment of the present invention.

FIGS. 2 to 6 are views illustrating a basic configuration of the speaker device according to an embodiment of the present invention. FIG. 2(*a*) is a plan view (the diaphragm is shown in virtual lines, thus illustrating a state omitting the diaphragm), FIG. 2(*b*) is a sectional view of FIG. 2(*a*) taken along line A-A. FIGS. 3 to 5 are views illustrating a driving part (FIG. 3 is a perspective view, FIG. 4 is an exploded perspective view, and FIG. 5 is a sectional view), and FIG. 6 is a view illustrating an operation of the vibration-direction-conversion part. Hereinafter, a sound emission direction (SD) is defined as Z-axis, a longitudinal direction of the speaker device is defined as X-axis, and a direction perpendicular to both X-axis and Z-axis is defined as Y axis.

A speaker device 1 according to an embodiment of the present invention has a diaphragm 2, a frame 3, and a driving part 4 as principal components. The outer periphery of the diaphragm 2 is supported through the edge 5 with the outer periphery 3A of the frame 3. The function of the edge 5 is to basically define the vibration of the diaphragm 2 exclusively in the Z-axis direction. When an audio signal is applied to the driving part 4, the driving part 4 is driven, and a vibration developed by the driving is transmitted to the diaphragm 2.

The driving part 4 includes a magnetic circuit 40, a voice coil supporting part 6, and vibration-direction-conversion part 7. The magnetic circuit 40 has a magnetic gap 40G formed in a direction (for example, X-axis direction) different from the vibration direction of the diaphragm 2 (for example, Z-axis direction). In an example shown in the drawing, the magnetic gap 40G is formed along the direction perpendicular to the vibration direction of the diaphragm 2, however the configuration is not limited to the example. The voice coil supporting part 6 has a voice coil 60 and is configured to vibrate along the magnetic gap 40G. The movement of the voice coil supporting part 6 is restricted by a damper 8 only in the direction along the magnetic gap 40G. When an audio signal is applied to the voice coil 60, the Lorenz force is developed in the voice coil 60 in the magnetic gap 40G, thereby causing the voice coil supporting part 6 integral with the voice coil 60 to vibrate.

The vibration-direction-conversion part 7 converts the vibration direction of the voice coil supporting part 6 and transmits the vibration to the diaphragm 2. The vibration-direction-conversion part 7 includes an after-mentioned link body in which a link part 70 (first link part) formed between the voice coil supporting part 6 and the diaphragm 2 is angle-converted such that the vibration of the voice coil supporting part 6 is direction-converted and transmitted to the diaphragm 2.

In accordance with this embodiment of the present invention, for example, an audio signal is transmitted from an audio signal source 50 to a terminal 52 provided in proximity of the frame 3 through a signal wire 51. The audio signal is further transmitted from the terminal 52 to the voice coil 60 of the voice coil supporting part 6 through the signal wire 53. Upon the audio signal inputted in the voice coil 60, the voice coil supporting part 6 vibrates along a magnetic gap 40G formed in a direction different from the allowed vibration direction of the diaphragm 2, and this vibration is direction-converted and transmitted to the diaphragm 2 by the vibration-direction-conversion part 7, thereby vibrating the diaphragm 2 to emit a sound corresponding to the audio signal in a sound emission direction (SD).

At this time, since the direction of the magnetic gap 40G is configured to cross the vibration direction of the diaphragm 2 and the thickness direction of the speaker device 1, an increase of the driving force of the magnetic circuit 40 or the vibration stroke of the voice coil supporting part 6 has directly little effect on the size of the speaker device 1 in the thickness direction (Z-axis direction). Accordingly, it becomes possible to make the speaker device in a thin shape while enabling a large volume. Further, it is structurally possible to make the speaker device 1 thinner than the vibration stroke (displacement) of the voice coil supporting part 6, thus the structure facilitates to produce a thin speaker device.

Further, since the vibration-direction-conversion part 7 is configured to convert the vibration direction of the voice coil supporting part 6 and transmit the vibration to the diaphragm 2 through a mechanical link body, the transmission efficiency of the vibration is high. Furthermore, since the angle conversion of the link part 70 is performed upon receiving the reaction force from the frame 3 as the stationary part against the vibration of the voice coil supporting part 6, the vibration of the voice coil supporting part 6 can be more securely transmitted to the diaphragm 2. This will enable the speaker device 1 to attain good reproduction efficiency, and in particular it will be possible to obtain good reproduction characteristic in high-tone range by securely transmitting the vibration of the voice coil 60 to the diaphragm 2.

Hereinafter, each of the components of the speaker device 1 according to the embodiment is described in detail.

[Frame 3]

The frame 3 supports the diaphragm 2 vibratably in the vibration direction and supports the driving part 4 therein. The frame 3 supports a part of a link body of the vibration-direction-conversion part 7 and, thus applies a reaction force corresponding to the operation of the link body to the link body. Such a frame 3 may include a planar bottom face 31A. Also, the frame 3 is a stationary part that is arranged to be stationary with respect to the voice coil supporting part 6. The stationary part, however is not necessary to be completely stationary and may be stationary enough to support the diaphragm 2, thus the vibration caused at the time of driving the speaker device 1 may be transmitted to generate a vibration in the whole stationary part. The stationary part as described above may include a part of the magnetic circuit 40 and a counterpart to which the speaker device 1 is attached.

Further, the stationary part may be arranged mechanically integrally with the after-mentioned magnetic circuit 40, and since the frame 3 is supported by the magnetic circuit 40 in a sense, the frame 3 can be stationary in this respect. Moreover, the members constituting the magnetic circuit 40 and other members supported by the magnetic circuit 40 may become a stationary part.

The frame 3 as shown in FIG. 2 is formed planarly in a rectangular shape and cross-sectionally in a concave shape when it is viewed from the sound emission direction (SD). As described in the drawings, specifically the frame 3 includes a planarly rectangular bottom plate 31, a tubular part 32 standing up toward the sound emission direction (SD) from the outer periphery of the bottom plate 31, and an opening 30 formed in the upper side. The magnetic circuit 40 is arranged on the bottom plate 31, the outer periphery of the edge 5 is joined to the upper end of the tubular part 32 with an adhesive or the like, and the diaphragm 2 supported through the edge 5 is arranged within the opening 30. In the example shown in the drawing, a flat outer periphery 3A extending inward is formed in proximity of the upper end of the tubular part 32 and the edge 5 is connected to this outer periphery 3A. Conventionally known materials such as resin and metal may be adopted as the material of the frame 3. Further, in the example shown in the drawing, although the frame 3 is made of a material different from the magnetic circuit 40, the lower flat end 41A of the yoke 41 constituting the after-mentioned magnetic circuit 40 may be further extended to have the tubular part 32 like the frame 3 and support the edge 5. Modifications may be appropriately applied to the configuration, for example, such that the upper flat end 41B may be further extended instead of the bottom flat end 41A.

Further, as shown in FIG. 2(*b*), a through-hole 33 is formed, for example in the side surface or the bottom surface of the frame 3. The through-hole 33 functions, for example as a vent hole. For example, if the vent hole is not provided, air within the space enclosed by the diaphragm 2 and the frame 3 may act as a spring according to the vibration of the diaphragm 2 when the speaker is driven. This may suppress the vibration of the diaphragm 2 as a result. In contrast, in the example shown in the drawing, since the through-hole 33 is provided, such a suppression of the vibration applied to the diaphragm 2 may be avoided. In addition, the through-hole 33 may function to release heat of the magnetic circuit 40 or the voice coil 60. Furthermore, the through-hole 33 may be used as passages through which a signal wire is disposed to electrically connect the voice coil 60 to an audio signal source 50 such as an amplifier, an equalizer, a tuner, a broadcasting receiver and a television, which are provided outside the speaker device, for example.

[Diaphragm 2]

The diaphragm 2 is vibratably supported by the frame 3 in the vibration direction (Z-axis direction), as shown in FIG. 2(*b*). The diaphragm 2 emits a sound wave in the sound emission direction (SD) when the speaker is driven. The diaphragm 2 is supported by the frame 3 through the edge 5, and movements in directions other than the vibration direction, specifically in the X or Y direction, are restrained by the edge 5. The edge 5 and the diaphragm 2 may be integrally formed.

The diaphragm 2 may be made of, for example, a resin, a metal, a paper, a ceramic, or a composite material. The diaphragm 2 may be rigid. The diaphragm 2 may be formed in a predetermined shape such as a plate shape, a dome shape, a cone shape, and so on. In the example shown in the drawing, the diaphragm 2 is formed in a plate shape, and is supported along the planar bottom face 31A of the frame 3. Also, the shape of the diaphragm 2 as viewed from the sound emission direction (SD) (planar shape) is formed in a predetermined shape such as a rectangular, elliptical, circular, polygonal shape and so on. In the drawings, the planar shape of the diaphragm 2 is formed in a rectangular shape.

Further, a projection may be provided on the front surface (sound emission side) or rear surface (opposite to sound emission side) of the diaphragm 2 as necessary. The projection functions to increase rigidity of the diaphragm 2. The projection may be formed on the surface of the diaphragm 2 in a straight line, annularly, or in a lattice pattern. Modifications may appropriately be applied to such patterns, for example, a plurality of projections in a straight line may be formed to the diaphragm 2.

Since the diaphragm 2 is vibratably supported by the frame 3 and the space enclosed by the diaphragm 2 and the frame 3 at the back side (opposite to the sound emission direction) of the diaphragm 2 is blocked off in the sound emission direction, it is possible to suppress the emission toward the sound emission direction of sound waves from the back of the diaphragm 2.

[Edge 5]

The edge 5 is arranged between the diaphragm 2 and the frame 3, and the inner periphery thereof supports the outer periphery of the diaphragm 2 and also holds the diaphragm 2 in a predetermined position by joining the outer periphery to the frame 3. Specifically, the edge 5 supports the diaphragm 2 vibratably in the vibration direction (Z-axis direction) and restrains a vibration in a direction perpendicular to the vibration direction. The edge 5 shown in the drawing is formed in a ring shape (annular shape) as viewed from the sound emission direction. As shown in FIG. 2(*b*), the edge 5 has a predetermined cross-sectional shape, such as convex, concave, or corrugated shape. In this embodiment, the edge 5 is formed in a concave shape toward the sound emission direction, but not limited thereto. The edge 5 may be formed in a convex shape in the sound emission direction. The edge 5 may be made of, for example, leather, a fabric, rubber, a resin, or each of which is sealed with a filler or rubber, otherwise a member of rubber or a resin formed into a predetermined shape, or the like.

[Magnetic Circuit 40]

The magnetic circuit 40 is arranged in the frame 3. The magnetic circuit 40 shown in the drawing is housed in the frame 3 as shown in FIG. 2(*b*), and the magnetic gap 40G is formed along the planar bottom face 31A of the frame 3. For example, an inner-magnet type magnetic circuit or an outer-magnet type magnetic circuit may be used as the magnetic circuit 40.

As a specific structure, the magnetic circuit 40 includes a yoke 41 and a magnet 42 as shown in FIGS. 4 to 5. The magnetic circuit 40 shown in the drawing includes a plurality of magnets 42A to 42D. In the magnetic circuit 40, the magnets 42 are provided on both sides of the magnetic gap 40G in the magnetic field direction. For example, the magnetic gap 40G is formed along the X-axis direction such that the voice coil 60 can move within a predetermined range along the X-axis direction.

The yoke 41 includes a lower flat part 41A, an upper flat part 41B, and a support 41C. The lower flat part 41A and the upper flat part 41B are arranged substantially parallel to each other with a predetermined interval between them, and the support 41C is formed in the center such that it extends in a substantially perpendicular direction with respect to the lower flat part 41A and the upper flat part 41B.

When an audio signal (current) flows in the voice coil 60 in the magnetic field of the magnetic gap 4G, the Lorentz force is developed in a direction perpendicular to each of the magnetic field direction and the electric current direction according to the Fleming's left-hand rule. In the speaker device 1 according to this embodiment, the voice coil 60 and the magnetic circuit 40 are configured such that the Lorentz force is developed in the voice coil 60 in a predetermined direction different from the vibration direction of the diaphragm 2, specifically, in a direction (X-axis direction) perpendicular to the vibration direction of the diaphragm 2 (Z-axis direction) to vibrate the voice coil 60 in the X-axis direction. The magnets 42A to 42D are arranged on the flat parts 41A and 41B. One magnetic gap 40G1 is formed by the magnets 42A and 42C while the other magnetic gap 40G2 is formed by the magnets 42B and 42D. This pair of magnetic gaps 40G1 and 40G2 is planarly formed side by side such that magnetic fields opposite to each other are generated.

The annular voice coil 60 according to this embodiment has a substantially rectangular shape as viewed from the sound emission direction (SD), and is configured to have straight parts 60A and 60C formed in the Y-axis direction and straight parts 60B and 60D formed in the X-axis direction. The straight parts 60A and 60C of the voice coil 60 are arranged in the magnetic gap 40G of the magnetic circuit 40 so as to generate a magnetic field in the Z-axis direction. A magnetic field need not be applied to the straight parts 60B and 60D of the voice coil 60. Also, even when magnetic fields are applied to the straight parts 60B and 60D, they are applied so that the Lorentz force developed in the straight parts 60B and 60D can cancel each other.

Further, since the voice coil 60 according to this embodiment is formed in a shape of a thin plate, it is possible to make a portion in the magnetic gap 40G comparatively large by increasing the winding number and thereby obtain a comparatively strong driving force when the speaker is driven.

In the magnetic circuit 40 according to this embodiment, a plurality of magnets 42A to 42D are magnetized such that the direction of a magnetic field in the straight part 60A of the voice coil 60 is opposite to the direction of a magnetic field in the straight part 60C as shown in FIG. 5. Also, the voice coil 60 according to this embodiment is configured in an annular shape such that an audio signal flowing in the straight part 60A and an audio signal flowing in the straight part 60C of the voice coil 60 are opposite to each other in direction.

In the speaker device 1 having the above configuration, when an audio signal is inputted to the voice coil 60, the Lorentz forces developed in the straight part 60A and straight part 60C are in the similar direction, and therefore a driving force is twice as strong as in such a configuration that, for example, a magnetic field is applied to only one of the straight parts 60A and 60C. Accordingly, using the magnetic circuit 40 and the voice coil 60 configured as described above, the speaker device 1 can be configured in a comparatively thin shape and also can achieve a comparatively strong driving force.

[Voice Coil Supporting Part 6]

The voice coil supporting part 6 includes the above-mentioned voice coil 60 and is formed to be movable along a direction different from the vibration direction of the diaphragm 2. In the embodiment shown in the drawing, the voice coil supporting part 6 is vibratably arranged along the magnetic gap 40G that is formed along the planar bottom face 31A of the frame 3. More specifically, the voice coil supporting part 6 of this embodiment is formed to be movable only in the X-axis direction and to be restrained in movements in other directions. The moving range of the voice coil supporting part 6 is restrained by dampers 8 as a restraint part in this embodiment, but is not limited to this embodiment. For example, the restraint element may be formed by using a rail, a guide member, a groove, or the like.

Further, the voice coil supporting part 6 includes the voice coil 60 arranged in the magnetic gap 40G of the magnetic circuit 40, and a planar insulating member 61 in form of extending from the voice coil 60 to outside of the magnetic gap 40G along the moving direction of the voice coil 60. Also, the voice coil supporting part 6 has an opening 62 and the voice coil 60 is arranged along the outer periphery of the opening 62. Since the voice coil supporting part 6 as configured above may have such a structure that the voice coil 60 is embedded into the insulating member 61, it is possible to reinforce the strength of the voice coil 60 and thereby reduce the distortion of the voice coil 60.

In this embodiment shown in the drawing, the opening 62 is loosely fitted to the support part 41C of the magnetic circuit 40 and the moving range of the voice coil supporting part 6 is restrained in this state. Specifically, the opening part 62 is formed in a rectangular shape and the interval between the sides along the moving direction of the voice coil supporting part 6 is substantially equal to or longer than the width of the support part 41C, and the interval between the sides in a direction perpendicular to the moving direction is relatively long in accordance with the moving range of the voice coil supporting part 6.

[Vibration-Direction-Conversion Part 7]

The vibration-direction-conversion part 7 includes a link body to angle-convert a link part (first link part) 70 formed between the voice coil supporting part 6 and the diaphragm 2 by using the vibration of the voice coil supporting part 6 and a reaction force received from the frame 3. Specifically, with reference to FIGS. 2 and 3, the vibration-direction-conversion part 7 includes a first link part 70 and a second link part 71. One end of the first link part 70 is a hinge part 70A between the first link part 70 and the voice coil supporting part 6 and the other end thereof is a hinge part 70B between the first link part 70 and the diaphragm 2. One end of the second link part 71 is a hinge part 71A between the second link part 71 and the middle portion of the first link part 70 while the other end is a hinge part 71B between the second link part 71 and the frame 3. The first link part 70 and the second link part 71 are obliquely arranged in directions different from the vibration direction of the voice coil supporting part 6 (for example, X-axis direction).

These link parts are a part to form the link body and basically are not flexible (having rigidity). Each of them has hinge parts at its both ends. The hinge parts can be formed by rotatably joining two members or by forming one member as a folding part that is foldable in any given angle. In the embodiment shown in the FIG. 2(*b*), the hinge part 71B is formed on a supporting part 34 (stationary part) formed protrudingly on the bottom face 31A of the frame 3.

In the embodiment as shown in FIGS. 2 and 3, the link body is formed by the first link part 70, the second link part 71, and the hinge parts 70A, 70B, 71A and 71B. In this embodiment, the hinge part 71B between the second link part 71 and the frame 3 is not displaceable, while other hinge parts 70A, 70B and 71A are displaceable. Thereby, the link body as the whole is structured to receive a reaction force from the frame 3 at the hinge part 71B. In this link body, when the hinge part 70A moves in the X-axis direction according to the vibration of the voice coil supporting part 6, the hinge part 70B moves along the Z-axis direction, thus the vibration of the voice coil supporting part 6 is direction-converted and transmitted to the diaphragm 2.

The vibration-direction-conversion part 7 according to one or more embodiments of the present invention can be formed by a plate member having a line-shaped folding part and the folding part may be the above-mentioned hinge part of the link body. Specifically, the first link part 70 and the second link part 71 can be formed with the plate members, while the hinge parts 70A, 70B, 71A and 71B of the link body can be formed by the line-shaped folding parts as shown in the drawings. According to this configuration, it is possible to join the first link part 70 to the diaphragm 2 in a line shape, which enables to apply the vibration to the planar diaphragm 2 uniformly along its width direction and vibrate the whole diaphragm 2 substantially in the same phase. In other words, this can suppress occurrence of a divided vibration, making it possible to reproduce a sound particularly in the high-tone range. In addition, each link part has a rigidity, which enables to suppress occurrence of vibrations in an eigen-frequency mode, thus preventing deflection vibration of the link part or the like from adversely affecting the vibration of the diaphragm 2, thereby suppressing deterioration of acoustic characteristic.

The vibration-direction-conversion part 7 according to this embodiment may have a vent hole for example, though not shown in the drawings. The vent hole can reduce local fluctuations of air pressure in the space enclosed by the diaphragm 2 and the frame 3 and prevents the damping of the vibration-direction-conversion part 7 due to air pressure. Further, a through-hole is formed for example on the link part by making the vent hole, which can reduce the weight of the link part and enables reproduction in high-tone range. Reducing the weight of the vibration-direction-conversion part can effectively broaden bandwidth of reproduction characteristic and increase the amplitude of a sound wave and the sound pressure level with respect to a predetermined voice current.

Further, vibration-direction-conversion part 7 may be constituted by an integral part connected at the folding part. In this case, the vibration-direction-conversion part 7 forming a complex link body can be instantly joined to the voice coil supporting part 6 or the diaphragm 2, which improves the assembly performance of the speaker device. Furthermore, the vibration-direction-conversion part 7 may be formed integrally with the voice coil supporting part 6 or the diaphragm 2 as well, for example.

[Damper 8]

Damper 8 holds the voice coil supporting part 6 at a predetermined position within the magnetic gap 40G such that the voice coil supporting part 6 does not contact the magnetic circuit 40, and also vibratably supports the voice coil supporting part 6 along the vibration direction (X-axis direction). The damper 8 restrains movements such that the voice coil supporting part 6 does not move in directions different from the vibrating direction of the voice coil supporting part 6, for example in the Z or Y-axis direction.

The damper 8 according to this embodiment is, for example, formed in a shape of a plate and thus has flexibility. The cross sectional shape of the damper 8 is formed in a curved line in the Y-axis direction, so as to be bendable. The damper 8 has a predetermined thickness in the Z-axis direction (larger than the thickness in the X-axis direction), and is formed in a shape to have rigidity particularly in the Z-axis direction. Also, the damper 8 may be formed to have a cross-section in a shape among various cross-sectional shapes such as a convex, a concave, and a corrugated shape, and the thickness thereof may either be uniform or nonuniform. The damper 8 joins to the voice coil supporting part 6 at one end and joins to the frame 3 at the other end. The damper 8 is not limited to this embodiment, and may be configured to join to the voice coil supporting part 6 at one end and join to the magnetic circuit 40 at the other end for example.

It is also possible to provide a rail, a groove, a step, a guide member, or the like in place of the above-mentioned damper 8 on the frame 3 for the movement restraint or the support of the voice coil supporting part 6. That is, the speaker device 1 may have such a structure that the voice coil supporting part 6 slides with an end of the voice coil supporting part 6 being fitted into a rail, a groove, a step, or the like.

[Operation]

FIG. 6 is a view illustrating an operation of the speaker device 1 according to an embodiment of the present invention. Specifically, FIG. 6(*b*) is a view illustrating a state of the vibration-direction-conversion part 7 when the diaphragm 2 is placed at a reference position. FIG. 6(*a*) is a view illustrating a state of the vibration-direction-conversion part 7 when the diaphragm 2 is displaced to the sound emission side with respect to the reference position. FIG. 6(*c*) is a view illustrating a state of the vibration-direction-conversion part 7 when the diaphragm 2 is displaced to the side opposite to the sound emission side with respect to the reference position.

As described above, the hinge part 71B is the only hinge part that is not displaced, which is supported by the frame 3, thus applying the reaction force from the frame 3 to the link body. Accordingly, when the voice coil supporting part 6 moves from the reference position X0 by X1 in the X-axis direction, the angles of the first and the second link parts 70 and 71 obliquely arranged in different directions are increased substantially by the same angle as shown in FIG. 6(*a*), and the hinge part 70B, receiving the reaction force from the frame at the hinge part 71B, securely pushes up the diaphragm 2 from the reference position Z0 by Z1 in the Z-axis direction. Further, when the voice coil supporting part 6 moves by X2 reversely in the X-axis direction the angles of the first and the second link parts 70 and 71 are decreased substantially by the same angle as shown in FIG. 6(*c*), and the hinge part 70B, receiving the reaction force from the frame 3 at the hinge part 71B, securely pushes down the diaphragm 2 from the reference position Z0 by Z2 reversely in the Z-axis direction.

The length a of the link part between the hinge parts 70A and 71A, the length b of the link part between the hinge parts 71A and 70B, and the length c of the link part between the hinge parts 71A and 71B may be configured to be similar so that the hinge parts 70A and 71B are arranged on a straight line in the moving direction of the voice coil supporting part 6. This link body is well known as Scott Russell linkage where the hinge parts 70A, 70B and 71B lie on a circumference of a circle having the diameter being the length of the first link part 70 (a+b=2a) and having the center at the hinge part 71A. Namely, the angle defined by the line passing the hinge parts 70A and 71B and the line passing the hinge parts 70B and 71B is always a right angle. Therefore; when the voice coil supporting part 6 is moved in the X-axis direction, the hinge part 70B between the first link part 70 and the diaphragm 2 always moves in the Z-axis direction that is perpendicular to the X-axis, thus it is possible to convert the vibration direction of the voice coil supporting part 6 to its perpendicular direction and transmit the vibration to the diaphragm 2.

The speaker device 1, as described above, has the magnetic gap 40G of the magnetic circuit 40 along the direction different from the vibration direction of the diaphragm 2, and transmits the vibration of the voice coil supporting part 6 vibrating along the magnetic gap 40G to the diaphragm 2 through the vibration-direction-conversion part 7. At this time, the vibration direction of the voice coil supporting part 6 may be perpendicular to the vibration direction of the diaphragm 2. According to this configuration, width of each part of the speaker device 1 can be accumulated in a direction different from the width direction (vibration direction of the diaphragm 2), the width along the sound emission direction (the total height of the speaker device) can be comparatively small relative to general speaker devices, thus the speaker device 1 can be made thin.

Further, compared with a speaker device transmitting a driving force by utilizing the bending of a flexible member when transmitting a driving force from the voice coil 60 to the diaphragm 2 for example, the speaker device 1 transmits a driving force from the voice coil supporting part 6 to the diaphragm 2 through the mechanical link body. Therefore a delay in response due to distortion of a flexible member is reduced, for example, and it is possible to vibrate the diaphragm 2 with a relatively high sensitivity. Further, since no flexible member frequently causing resonance (especially at a low frequency) is used, it is possible to efficiently transmit a driving force of the driving part 4 to the diaphragm 2.

Further, since the speaker device 1 angle-converts a driving force developed in the voice coil 60 of the driving part 4 and transmits the driving force to the diaphragm 2 through the mechanical link body, the deterioration in the quality of reproduced sound as seen in a capacitive speaker device when producing a large sound can be suppressed. Therefore, it is possible to emit a high quality reproduced sound in a large volume compared with the capacitive speaker device.

Further, the speaker device 1 can be configured to have the planar bottom face 31A, support the diaphragm 2 along the bottom face 31A, and form the magnetic gap 40G along the bottom face 31A, thus enabling to form the whole speaker device 1 to be planar and thin. Furthermore, the vibration-direction-conversion part 7 vibrating the diaphragm 2 in the direction crossing (e.g., perpendicular to) the bottom face 31A by receiving the reaction force from the bottom face 31A of the frame 3, the vibration direction of the voice coil supporting part 6 along the magnetic gap 40G does not directly affect the thickness direction of the speaker device 1. Therefore, this configuration enables to make small the total height of the speaker device 1 small, while making the vibration of the voice coil supporting part 6 and the driving force large, and thus enabling both a large volume of sound output and a thin shape of the speaker device. In addition, the voice coil 60 being formed in a shape of a thin plate, it is possible to make a part of the voice coil 60 in the magnetic gap 40G comparatively large by increasing the winding number and thereby obtain a comparatively large driving force.

Figure 7:
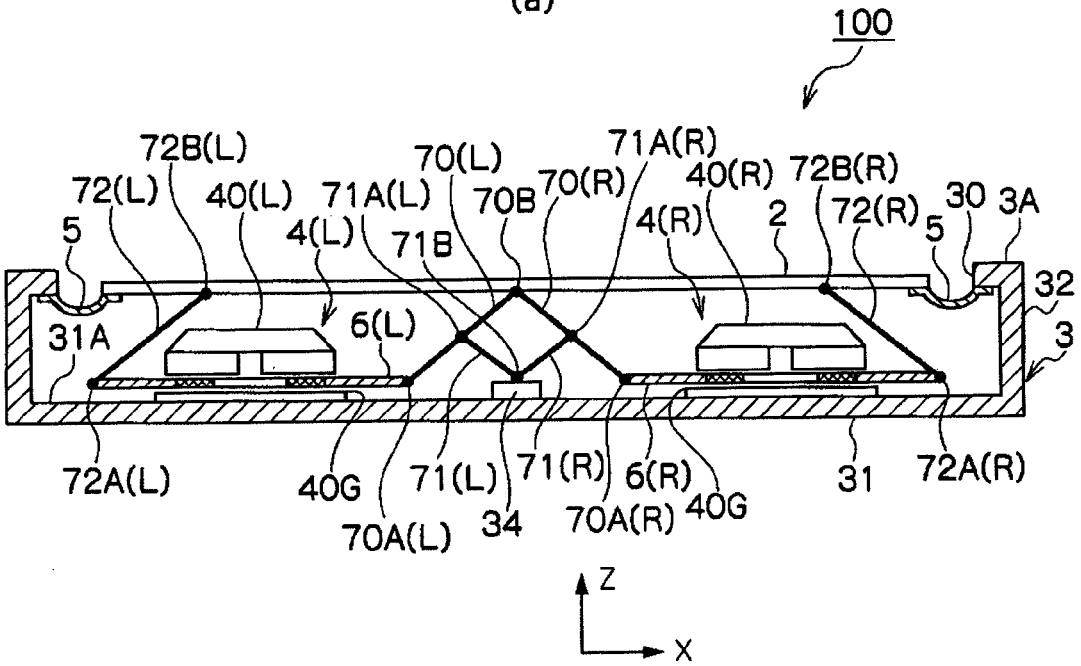
FIG. 7(*a*) is a view illustrating a speaker device according to another embodiment of the present invention.
Figure 7:
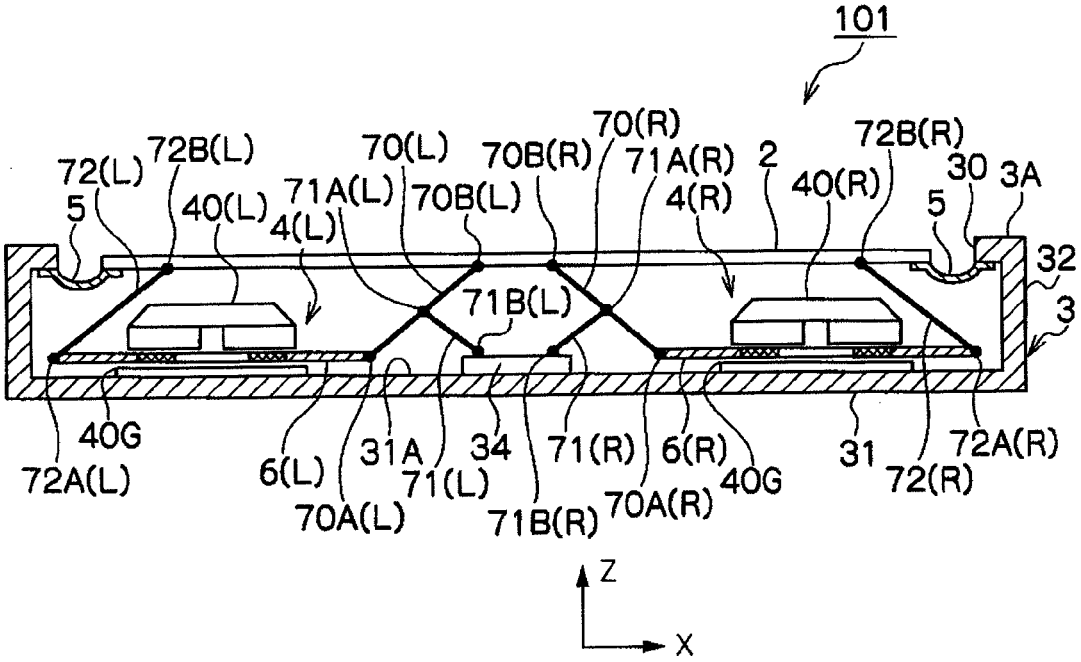
Figure 8:
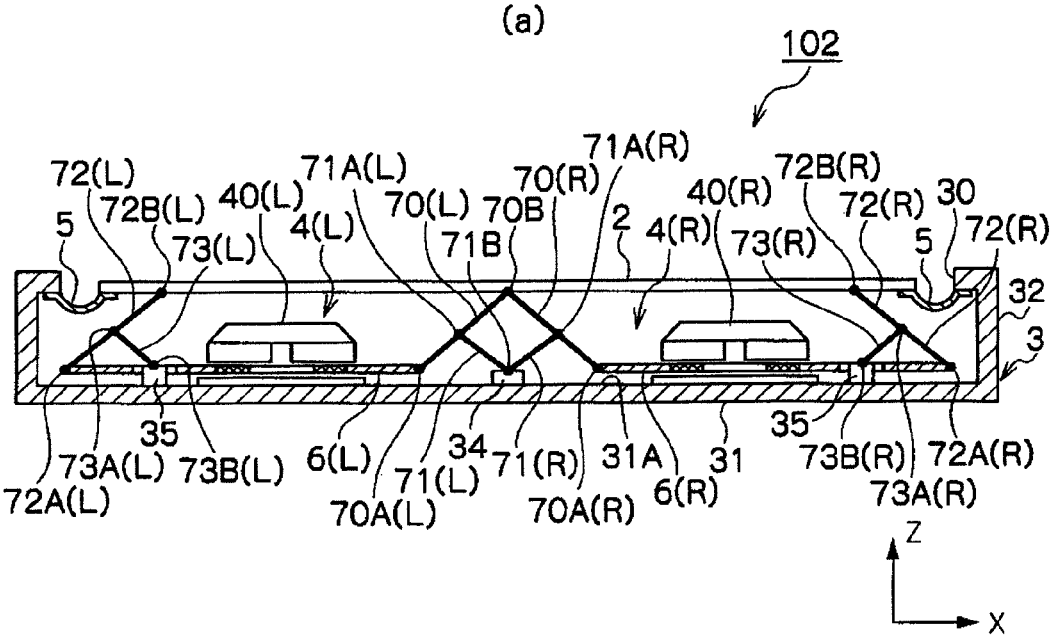
FIG. 8 is a view illustrating a speaker device according to another embodiment of the present invention.
Figure 8:
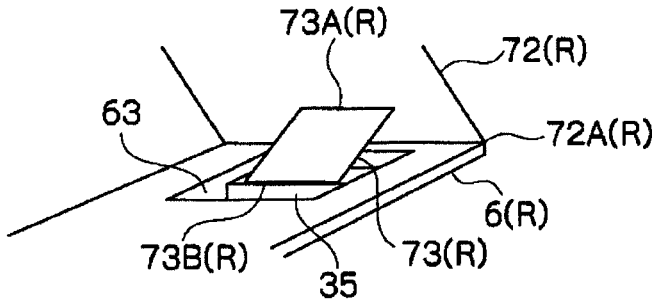
Figure 8:
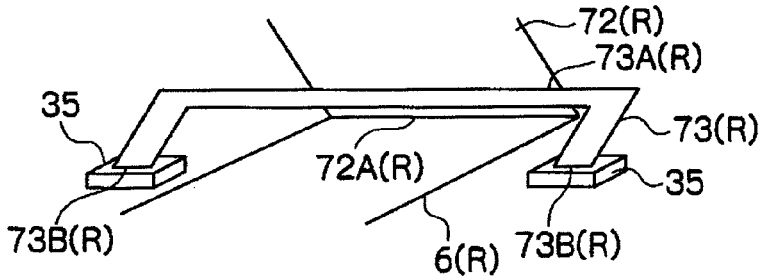

FIGS. 7 and 8 are views illustrating speaker devices according to other embodiments of the present invention. The same symbols are applied to the same parts and the description is not repeated. The embodiments shown in FIGS. 7(*a*), 7(*b*) and FIG. 8 have two features respectively. The one is that the vibration-direction-conversion parts 7 are arranged at both ends of the voice coil supporting part 6 in the vibration direction and a set of parallel links are formed with the link parts of the vibration-direction-conversion part 7 provided at both ends of the voice coil supporting part 6. The other feature is that a pair of driving parts 4 is provided and the vibration-direction-conversion parts 7 are symmetrically arranged opposite to each other.

The speaker devices 100 and 101 as shown in FIGS. 7(*a*) and 7(*b*) include a pair of right and left driving parts 4(R) and 4(L) respectively to a single diaphragm 2. The driving parts 4(R) and 4(L) are arranged symmetrically. Namely, the driving part 4(R) includes a magnetic circuit 40(R) and a voice coil supporting part 6(R). A first link part 70(R) and a second link part 71(R) are provided on the end of the voice coil supporting part 6(R) on the center side of the diaphragm 2. An outside link part 72(R) is provided on the outside end of voice coil supporting part 6(R) with one end as a hinge part 72A(R) between the outside link part 72(R) and the voice coil supporting part 6(R) and the other end as a hinge part 72B(R) between the outside link part 72(R) and the diaphragm 2. Similarly, the driving part 4(L) includes a magnetic circuit 40(L) and a voice coil supporting part 6(L). A first link part 70(L) and a second link part 71(L) are provided on the end of the voice coil supporting part 6(L) on the center side of the diaphragm 2. An outside link part 72(L) is provided on the outside end of voice coil supporting part 6(L) with one end as a hinge part 72A(L) between the outside the link part 72(L) and the voice coil supporting part 6(L) and the other end as a hinge part 72B(L) between the outside link part 72(L) and the diaphragm 2.

In the vibration-direction-conversion parts provided on the ends of the voice coil supporting part 6(L) and 6(R) on the center side of the diaphragm 2 respectively in the speaker device 100 as shown in FIG. 7(*a*), the hinge part 70B of the first link parts 70(L) and 70(R) to the diaphragm 2 forms a common part, while the hinge part 71B of the second link parts 71(L) and 71(R) to the frame 3 forms a common part. In this configuration, a rhombic link body is formed with the hinge parts 70B, 71A(R), 71A(L) and 71B and the vibrations of the voice coil supporting parts 6(R) and 6(L) as moving close to and away from each other respectively in the X-axis direction are direction-converted to apply the vibration to the diaphragm 2 in the Z-axis direction (sound emission direction). Also, in this case, the hinge part 71B being supported by the frame 3, the link body constituted by the first link parts 70(R) and 70(L), and the second link parts 71(R) and 71(L) receives the reaction force from the frame 3 corresponding to the vibrations of the voice coil supporting parts 6(R) and 6(L) as moving close to and away from each other, thereby the diaphragm 2 is securely vibrated in the Z-axis direction by this reaction force.

The first link part 70(R) and the outside link part 72(R) provided on both ends of the voice coil supporting part 6(R) in the vibration direction or the first link part 70(L) and the outside link part 72(L) provided on both ends of the voice coil supporting part 6(L) in the vibration direction form a set of parallel links respectively. Accordingly, the first link part 70(R) and the outside link 72(R) disposed substantially in parallel to each other, or the first link part 70(L) and the outside link part 72(L) arranged substantially in parallel to each other, perform an angle-conversion substantially with the same angle corresponding to the movements of the voice coil supporting parts 6(R) and 6(L) in the X-axis direction. Thus, the three hinge parts 70B, 72B(R) and 72B(L) vertically move with the diaphragm 2 being planarly held, enabling a vibration of the diaphragm 2 substantially in the same phase, which can suppress occurrence of divided vibration. At this time, the voice coil supporting parts 6(R) and 6(L) are required to vibrate substantially in the same phase, and the same amplitude, and in opposite directions to each other.

In the speaker device 101 as shown in FIG. 7(*b*), the hinge part 70B is divided into hinge parts 70B(R) and 70B(L) which are distantly arranged from each other. Similarly, the hinge part 71B is divided into hinge parts 71B(R) and 71B(L) which are distantly arranged from each other. Other than this, the configuration of the speaker device 101 is the same as the speaker device 100 as shown in FIG. 7(*a*). Accordingly, the speaker device 101 as shown in FIG. 7(*b*) exhibits similar functions to the speaker device 100 as shown in FIG. 7(*a*). However, since the speaker device 101 has hinge parts at four positions 70B(R), 70B(L), 72B(R) and 72B(L) concurrently moving vertically to move diaphragm 2 vertically, thereby enabling to suppress the divided vibration of the diaphragm 2 furthermore.

The embodiment as shown in FIG. 8 is the same as the embodiment shown in FIG. 7 other than the link body of the outside link parts. Although the embodiment shown in FIG. 8 corresponds to the embodiment shown in FIG. 7(*a*), it may similarly correspond to the embodiment shown in FIG. 7(*b*) by simply changing the outside link parts. The same symbols are applied to the common parts as those in FIG. 7 not to repeat the same description. FIG. 8(*a*) is a sectional view of the whole device, and FIGS. 8(*b*) and 8(*c*) are views illustrating the hinge part between the outside link part and the frame. The outside link part of this speaker device 102 includes first outside link parts 72(R) and 72(L) and second outside link parts 73(R) and 73(L). A pair of substantially symmetrical driving parts 4(R) and 4(L) is provided here too.

Speaker device 102 includes the first outside link part 72(R) and 72(L) having a hinge part 72A(R) or 72A(L) to the outside portion of the voice coil supporting parts 6(R) or 6(L) at one end, and a hinge part 72B(R) or 72B(L) to the diaphragm 2 at the other end, and the second outside link part 73(R) and 73(L) having a hinge part 73A(R) or 73A(L) to the middle portion of the first outside link part 72(R) and 72(L) at one end, and a hinge part 73B(R) or 73B(L) to the frame 3 at the other end. In this embodiment, the hinge parts 73B(R) and 73B(L) are supported by the frame 3 through a supporting part 35.

The hinge parts 73B(R) and 73B(L) between the second outside link part 73(R) and 73(L), and the frame 3 are described hereinafter. As shown in FIG. 8(*b*), the voice coil supporting part 6(R) has an opening 63 through which the end of the second outside link part 73(R) may be supported by the frame 3 through the supporting part 35, or it may be supported as shown in FIG. 8(*c*) where the second outside link part 73(R) has its ends formed in a portal shape with its both ends over the voice coil supporting part 6(R) being supported by the frame 3 through the supporting parts 35. Although the drawing shows only the example of the right side, the left side is similar to the right side. They are configured almost symmetrically.

According to this embodiment, the link body can be formed to receive the reaction force from the frame 3 in the link parts arranged in outer ends of the voice coil supporting parts 6(R) and 6(L). Accordingly, the first outside link parts 72(R) and 72(L) can be angle-converted by using the reaction force from the frame 3 corresponding to the movement of the voice coil supporting parts 6(R) and 6(L), thereby securely moving the diaphragm 2 up and down.

Further in this embodiment, since the link body constituted by the first link parts 70(R) and 70(L), and the second link parts 71(R) and 71(L) always receives the reaction force from the frame 3 corresponding to the movement of voice coil supporting parts 6(R) and 6(L) along the X-axis direction, the vertical movement of the voice coil supporting parts 6(R) and 6(L) can be suppressed by the reaction force received from the diaphragm 2 when the link body moves the diaphragm up and down (in the Z-axis direction). This enables a smooth vibration of the voice coil supporting parts 6(R) and 6(L) and a smooth transmission of the vibration to the diaphragm 2.

Figure 9:
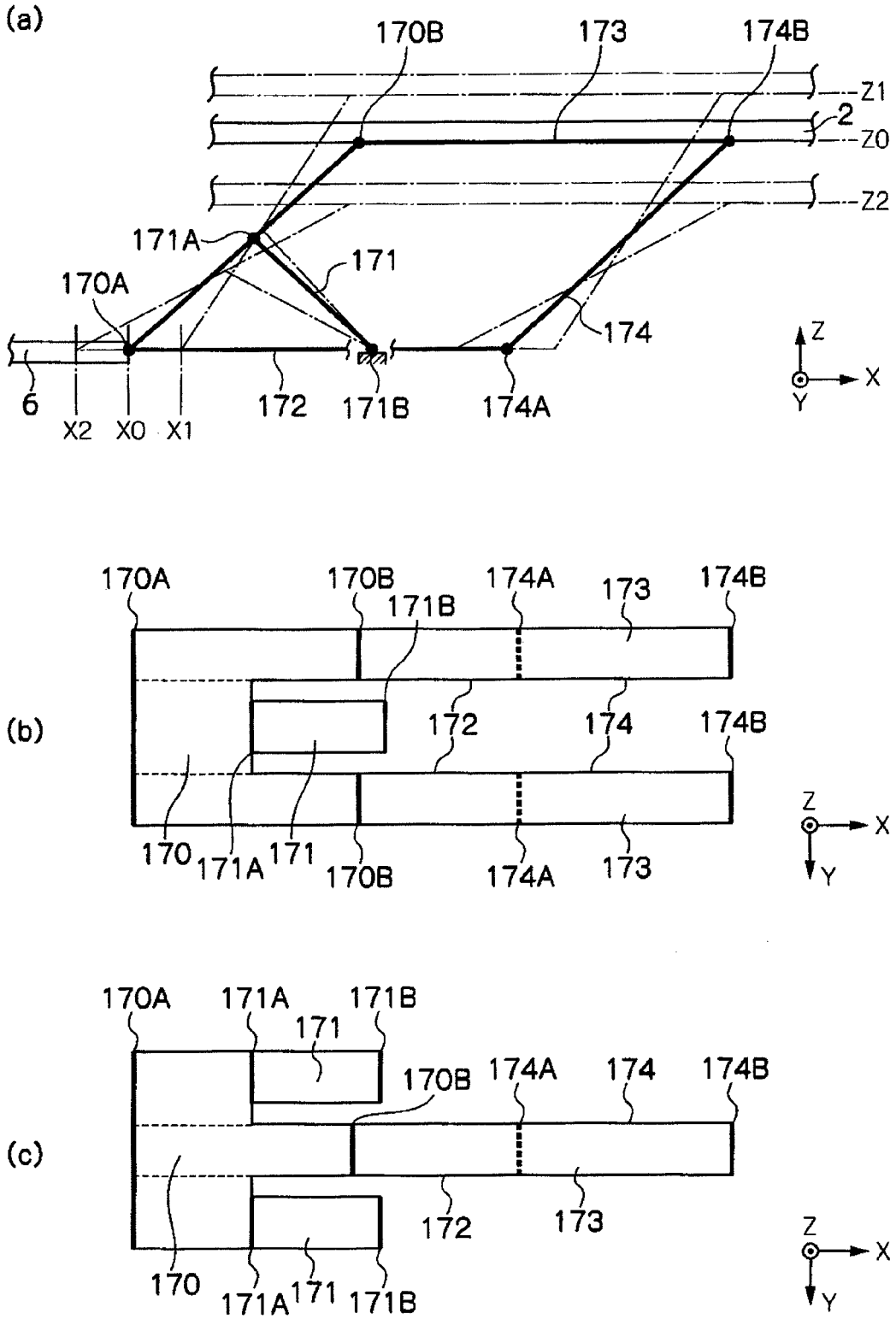
FIG. 9 is a view illustrating a part of the speaker device (the vibration-direction-conversion part) according to an embodiment of the present invention.

FIG. 9 is a view illustrating a part of the speaker device according to an embodiment of the present invention (FIG. 9(*a*) is a side view, and FIGS. 9(*b*) and 9(*c*) are plan views of the vibration-direction-conversion part). The drawings illustrate another embodiment of the vibration-direction-conversion part where the vibration of the voice coil supporting part 6 is direction-converted and transmitted to the diaphragm 2.

The vibration-direction-conversion part includes a first link part 170 having a hinge part 170A to the voice coil supporting part 6 at one end, and a hinge part 170B to the diaphragm 2 at the other end; a second link part 171 having a hinge part 171A to the middle portion of the first link part 170 at one end, and a hinge part 171B to the frame 3 at the other end; a third link part 172 integrally extending from the voice coil supporting part 6 or formed as a part of the voice coil supporting part 6; a fourth link part 173 fixed along the diaphragm 2 or formed as a part of the diaphragm 2; and a fifth link part 174 having a hinge part 174A to the end of the third link part 172 at one end, and a hinge part 174B to the fourth link part 173 at the other end. The first link part 170 and the fifth link part 174, and the third link part 172 and the fourth link part 173 form a parallel link respectively.

In this vibration-direction-conversion part, when the hinge part 170A moves from a reference position X0 to X1 in the X-axis direction corresponding to the vibration of the voice coil supporting part 6, the third link part 172 and the fourth link part 173 forming a parallel link are kept in a parallel state while the first link part 170 and the fifth link part 174 are angle-converted to be raised. At this time, since the hinge part 171B is supported by the frame 3, the angle-conversion of the first link part 170 and the fifth link part 174, upon receiving the reaction force from the frame 3, is securely performed, thereby the displacement of the voice coil supporting part 6 from position X0 to position X1 is securely converted to the displacement of the diaphragm 2 from position Z0 to position Z1.

Similarly, when the hinge part 170A moves from the reference position X0 to X2 in the X-axis direction, the third link part 172 and the fourth link part 173 forming a parallel link are kept in a parallel state while the first link part 170 and the fifth link part 174 are angle-converted to be laid. At this time, since the hinge part 171B is supported by the frame 3, the angle-conversion of the first link part 170 and the fifth link part 174, upon receiving the reaction force from the frame 3, is securely performed, thereby the displacement of the voice coil supporting part 6 from position X0 to position X2 is securely converted to the displacement of the diaphragm 2 from position Z0 to position Z2.

According to this embodiment, the vibration of the voice coil supporting part 6 in the X-axis direction is converted to the vibration in the Z-axis direction at two hinge parts 170B and 174B, and the fourth link part 173 vibrating substantially in the same phase and substantially with the same amplitude. Accordingly, the diaphragm 2 is supported in a broad area and receives the vibration with substantially same phase and amplitude, thus the vibration of the voice coil supporting part 6 can be transmitted substantially in the same phase to the diaphragm 2 having a planarly broad area.

The link body of the vibration-direction-conversion part shown in FIG. 9(*a*) can be formed with link parts, each of them having a plate member as shown in FIGS. 9(*b*) and 9(*c*). Each of the hinge parts may be made by rotatably joining link parts mutually or foldably connecting or integrally forming the link parts mutually.

The plate member may have high rigidity and be light in weight and fiber-reinforced plastic film or the like.

In the embodiment as shown in FIG. 9(*b*), third link parts 172, the fourth link parts 173 and the fifth link parts 174 are parallel arranged in pair respectively. The first link part 170 is formed to be bifurcated and the hinge part 171A to the second link part 171 is formed in the middle portion thereof. The second link part 171 is arranged between the pair of parallel arranged third link parts 172, fourth link parts 173 and fifth link parts 174.

In the embodiment as shown in FIG. 9(*c*), the third link part 172, the fourth link part 173, and the fifth link part 174 are arranged in a center and the hinge part 171A is disposed in the middle portion of the first link part 170 at both sides, while the second link part 171 is formed at both sides of the first link part 170 having an extending middle portion.

Since the link body is formed with a single plate member, the diaphragm 2 can be vibrated supported by plane, thereby the whole diaphragm 2 can be vibrated substantially in the similar phase furthermore, enabling to suppress the divided vibration. The link parts may be formed with a plurality of plate members, however manufacturing process can be simplified by forming the link parts with a single plate member. When making the link parts with a single plate member, the link parts may be cut out of a single planar plate member. In the embodiment shown in FIG. 9, the speaker device may have a pair of driving parts with the vibration-direction-conversion parts being substantially symmetrically arranged opposite to each other as shown in FIG. 7. In this case, since the diaphragm 2 may be supported at a plurality of points and vibrated substantially in the similar phase, thus enabling to suppress the divided vibration furthermore.

Figure 10:
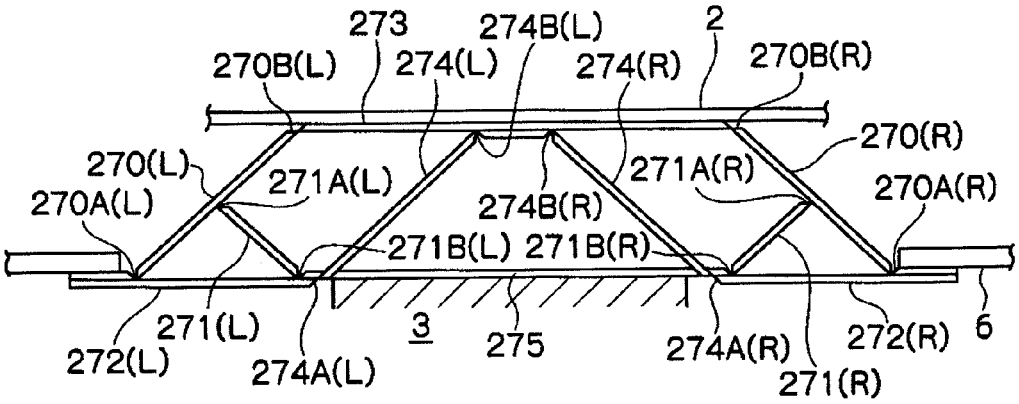
FIG. 10 is a view illustrating a part of the speaker device (a link body of the vibration-direction-conversion part) according to an embodiment of the present invention.
Figure 10:
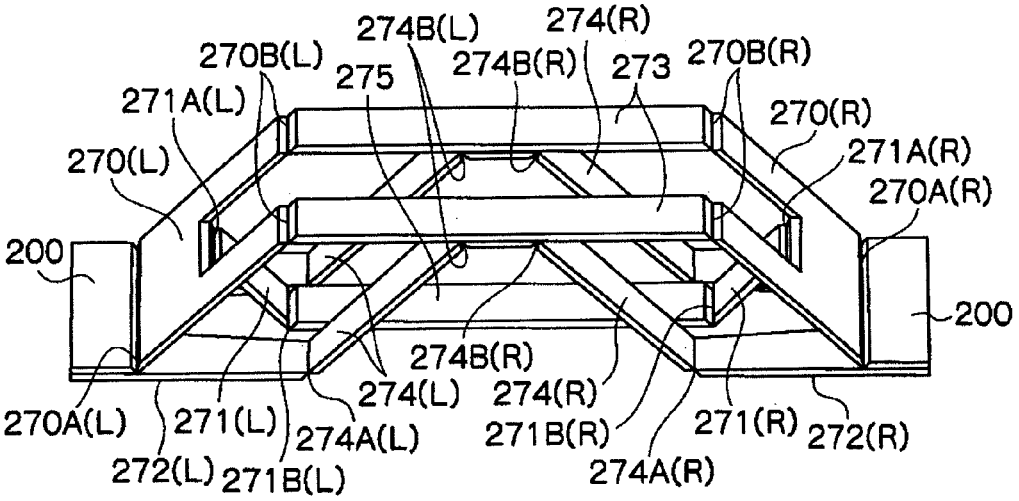
Figure 10:
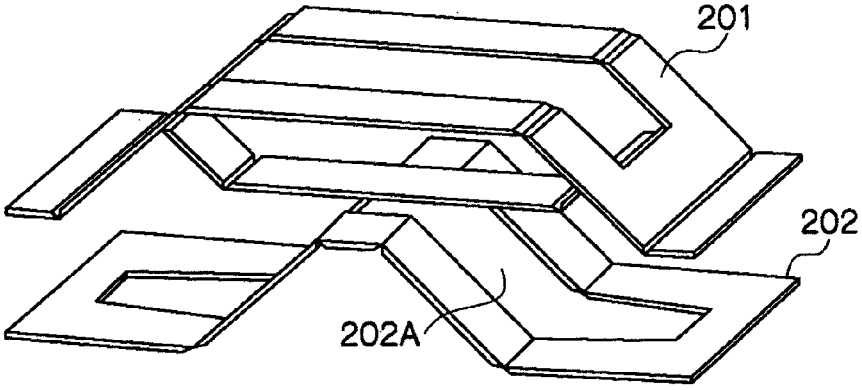

FIG. 10 is a view illustrating a part of the speaker device according to an embodiment of the present invention (FIG. 10(*a*) is a side view, FIG. 10(*b*) is a perspective view, and FIG. 10(*c*) is an exploded perspective view). The drawing shows another embodiment of the vibration-direction-conversion part for direction-converting the vibration of the voice coil supporting part 6 and transmitting the vibration to the diaphragm 2. This embodiment shows an example where a pair of driving parts is provided with the vibration-direction-conversion parts being parallel arranged opposite to each other substantially symmetrically, while the vibration-direction-conversion parts are formed with integral parts.

The vibration-direction-conversion part according to this embodiment includes a pair of first link parts 270(R) and 270(L) having hinge parts 270A(R) and 270A(L) to the voice coil supporting part 6 at one end, and having a hinge parts 270B(R) and 270B(L) to the diaphragm 2 at the other end. Also, it includes a pair of second link parts 271(R) and 271(L) having a hinge parts 271A(R) and 271A(L) to the middle portions of the first link parts 270(R) and 270(L) at one end, and having hinge parts 271B(R) and 271B(L) to the frame 3 (after-mentioned sixth link part 275) at the other end. Further The vibration-direction-conversion part includes a pair of third link parts 272(R) and 272(L) integrally extending from the voice coil supporting part 6 and a fourth link part 273 fixed along the diaphragm 2. Moreover it includes a pair of fifth link parts 274(R) and 274(L) having hinge parts 274A(R) and 274A(L) to the end of the third link parts 272(R) and 272(L) at one end, and having hinge parts 274B(R) and 274B(L) to the fourth link part 273 at the other end. The hinge parts 270B(R) and 270B(L) between the first link part 270 and the diaphragm 2 (the fourth link part 273) are formed at both ends of the fourth link part 273, and the hinge parts 271B(R) and 271B(L) between the second link parts 271(R) and 271(L) and the frame 3 (after-mentioned sixth link part 275) are formed at both ends of a sixth link part 275 having substantially the same length as the fourth link part 273. Further, the first link part 270(R) and the fifth link part 274(R), or the first link part 270(L) and the fifth link part 274(L) form a parallel link respectively, while the third link parts 272(R) and 272(L) and the fourth link part 273 form a parallel link respectively.

This link body of the vibration-direction-conversion part is substantially equivalent to link bodies of the embodiment shown in FIG. 9 almost symmetrically arranged opposite to each other with the hinge parts 174B being distantly arranged. In this embodiment, each link part is formed with a plate member and each hinge part between the link parts is formed by a line-shaped folding part, such that the link parts are integrally formed through the folding part between the link parts.

Further, slant surfaces are formed near the hinge parts on ends of the link parts. In particular, the slant surface is formed at the side surface opposite to the side surface of the link parts coming to close each other when the link part folds at the hinge part, such that each link part efficiently folds. Specifically, the vibration-direction-conversion part including such a link body is formed with an integral part as shown in FIG. 10(*b*) and at the ends a connecting part 200 of the voice coil supporting body 6 is formed.

Further, in the vibration-direction-conversion part of this embodiment, the first link parts 270(R) and 270(L), and the fourth link part 273 are formed by folding a whole single plate member forming the link parts in a convex-trapezoid shape, while the second link parts 271(R) and 271(L), and the sixth link part 275 are formed by folding a partly cut portion of this plate member in a concave-trapezoid shape.

Further, the vibration-direction-conversion part is formed by attaching two plate members 201 and 202 to each other as shown in FIG. 10(*c*). The first link parts 270(R) and 270(L), the second link parts 271(R) and 271(L), the fourth link part 273 and the sixth link part 275 are formed with one plate member 201, while the third link parts 272(R) and 272(L) and the fifth link parts 274(R) and 274(L) are formed with the other plate member 202. And, the third link parts 272(R) and 272(L) and the fifth link parts 274(R) and 274(L) are formed along the first link parts 270(R) and 270(L) and the fourth link part 273, and an opening 202A corresponding to the second link parts 271(R) and 271(L) and the sixth link part 275 is formed in the plate member 202.

In the embodiment as shown in FIG. 10(*c*), the opening 202A formed in the other plate member 202 corresponding to the second link parts 271(R) and 271(L) and the sixth link part 275 is formed so as to expand inward from one end of the other plate member 202.

This configuration may prevent the second link parts 271(R) and 271(L), and the sixth link part 275 from contacting the other plate member 202, enabling a smooth movement of the link body.

In such an embodiment, since the link body of the vibration-direction-conversion part can be formed simply with a single integral part being attached to two voice coil supporting parts 6 opposite to each other, the assembling process of a speaker device even with a pair of driving parts can be facilitated. Further, the sixth link part 275 enables to always hold the hinge parts 271B(R) and 271B(L) in fixed positions on the frame 3 without particularly fixing them onto the frame 3 corresponding to opposing vibrations of the voice coil supporting parts 6 (a plurality of the voice coil supporting parts vibrate in directions opposite to each other), thereby facilitating the incorporation of the vibration-direction-conversion part into the speaker device.

Further, since the right side first link part 270(R) and the third link part 274(R), and the left side first link part 270(L) and the third link part 274(L) form parallel links in the link body, the fourth link part 273 fixed to the diaphragm 2 can be parallel moved stably along the Z-axis direction corresponding to the opposing vibrations of the voice coil supporting parts 6, thereby enabling to apply a stable vibration to the planar diaphragm 2.

Figure 11:
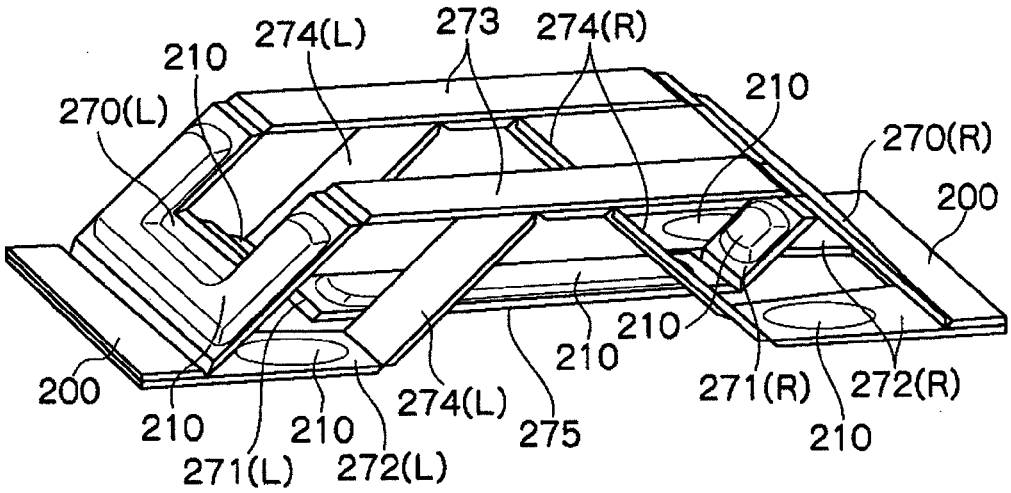
FIG. 11(*a*) is a view illustrating a part of the speaker device (a link body of the vibration-direction-conversion part) according to an embodiment of the present invention.
Figure 11:
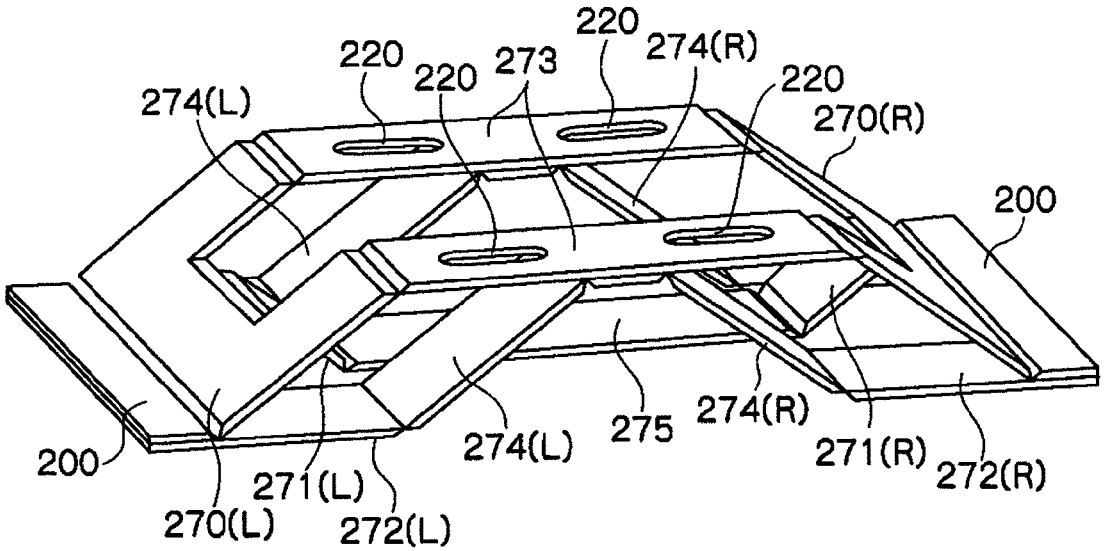

FIG. 11 illustrates an improved embodiment of the embodiment shown in FIG. 10. In this embodiment shown in FIG. 11(*a*), a convex portion 210 is provided on the link part which is subject to bend by the opposing vibrations of the voice coil supporting part 6 in order to increase the rigidity. As shown in the drawing, the first link part 270(R) and 270(L), the second link parts 271(R) and 271(L), the third link parts 272(R) and 272(L) and the sixth link part 275 are provided with the convex portion 210 respectively. In addition, in the embodiment shown in FIG. 11(*b*), an opening 220 is provided in the link part which does not particularly need strength in order to make the vibration-direction-conversion part light in weight. In the drawing, the fourth link part 273 has the openings 220. The vibration-direction-conversion part is effectively formed light in weight to broaden a bandwidth of a reproduction characteristic or increase the amplitude and sound pressure level of a sound wave corresponding to a predetermined voice current.

Specific Embodiments

Figure 12:
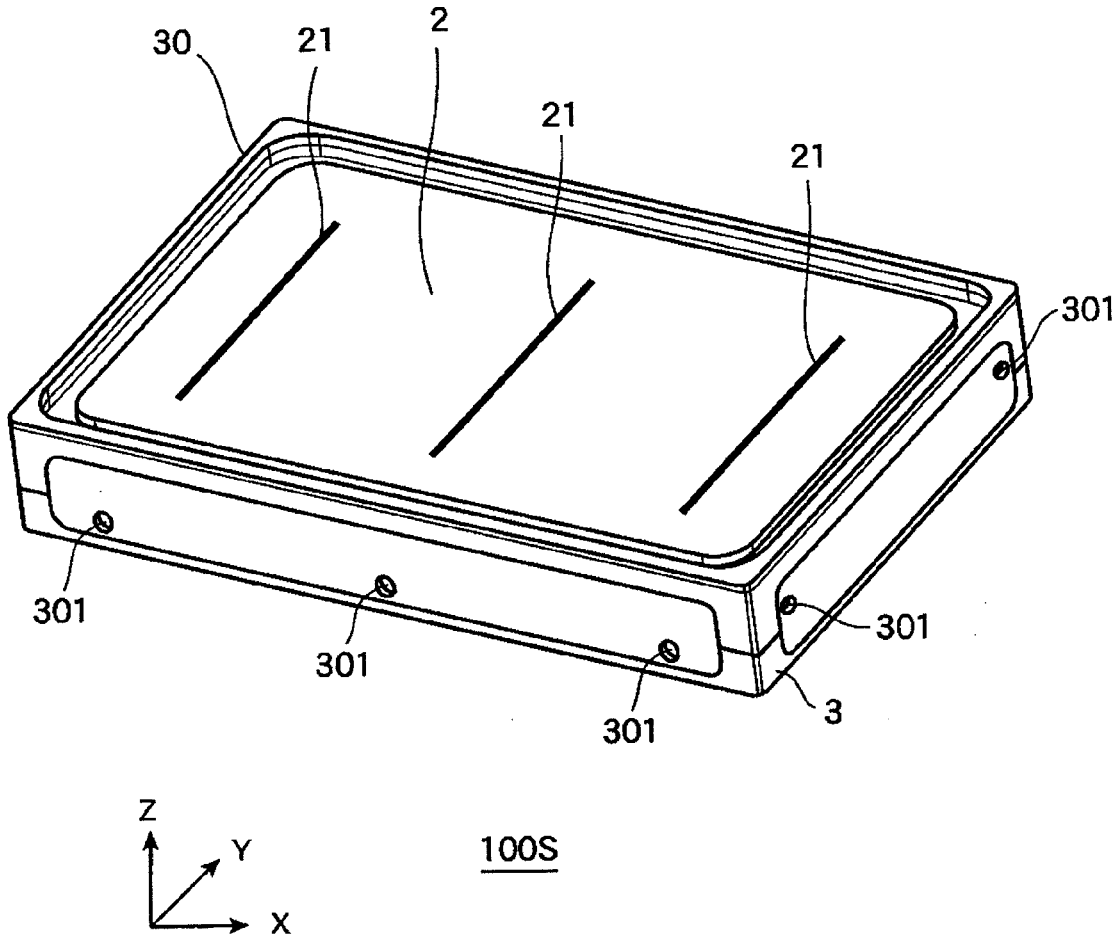
FIG. 12 is a perspective view illustrating a specific embodiment of the present invention.
Figure 13:
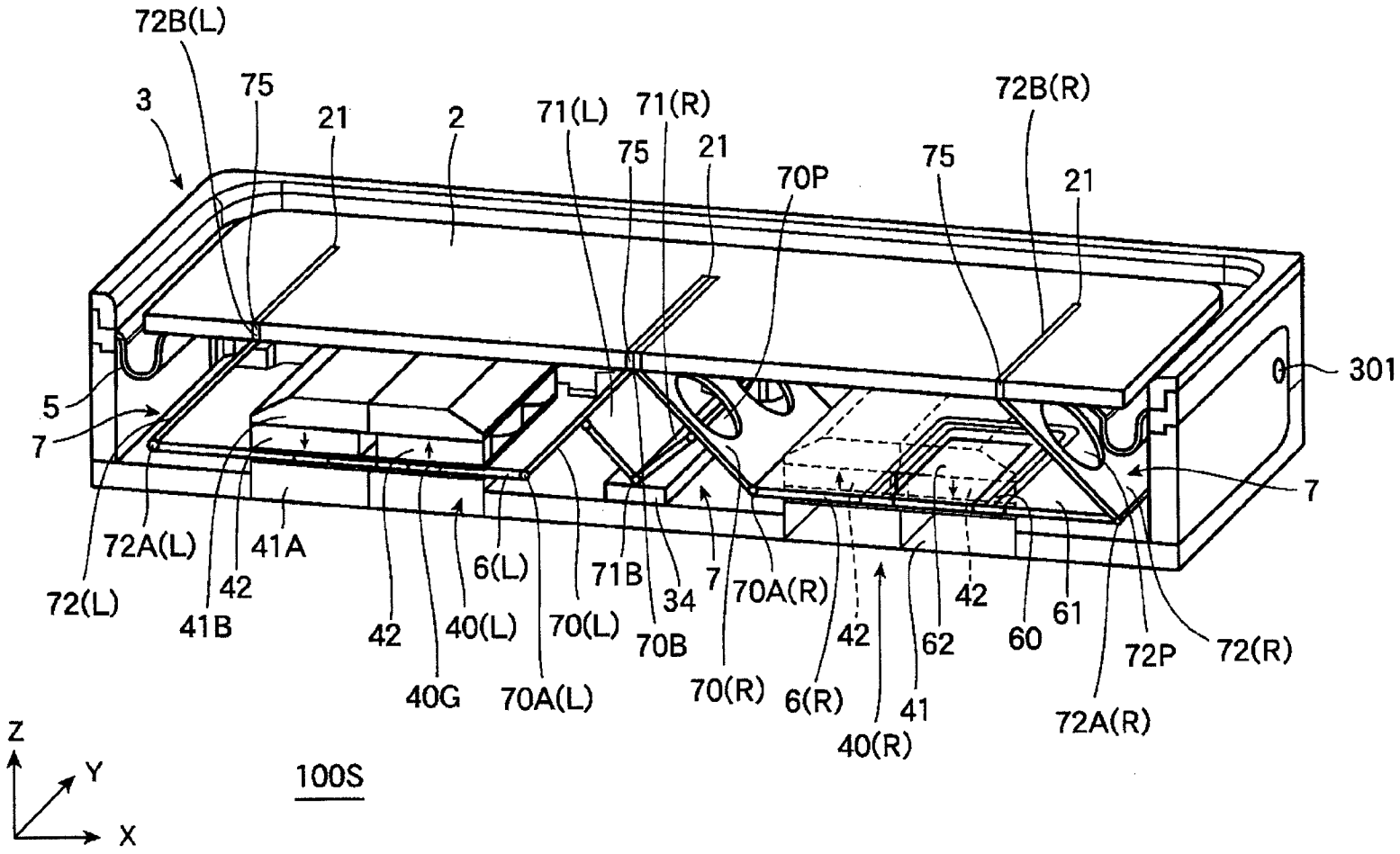
FIG. 13 is a perspective sectional view illustrating a specific embodiment of the present invention.
Figure 14:
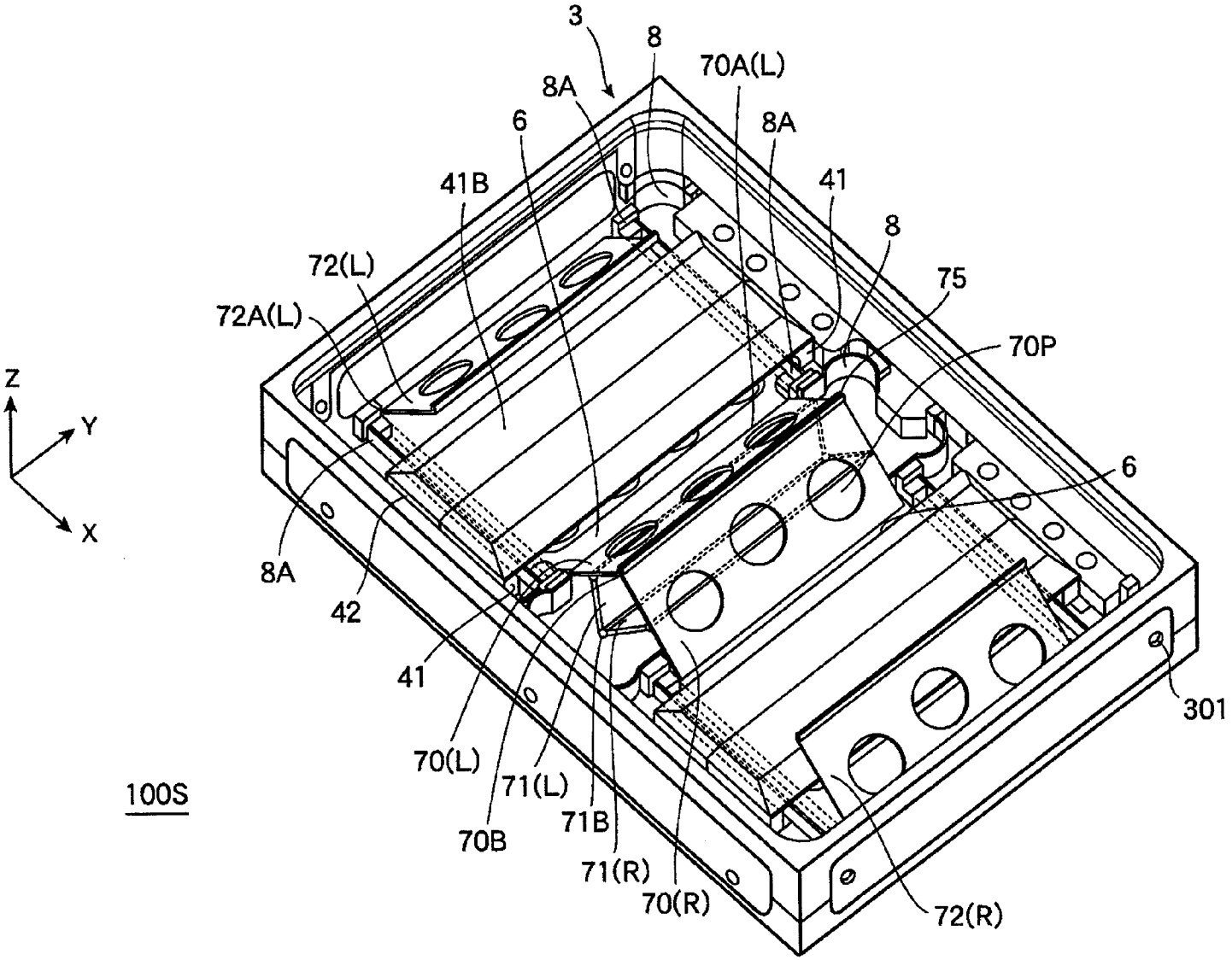
FIG. 14 is a perspective top view illustrating a specific embodiment of the present invention.
Figure 15:
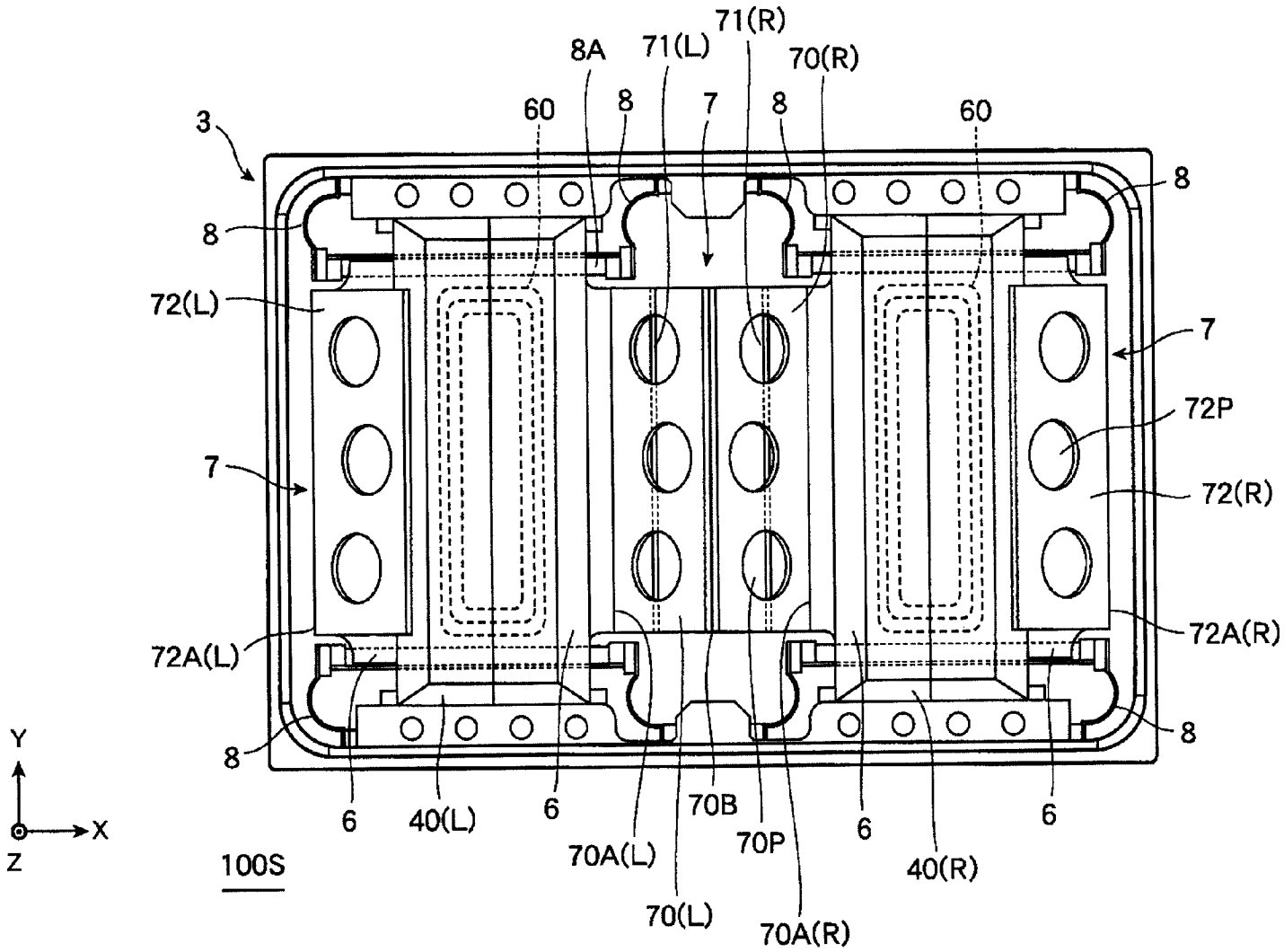
FIG. 15 is a top view illustrating a specific embodiment of the present invention.

Hereinafter, specific embodiments of the present invention are described with reference to the drawings. FIG. 12 is a perspective view of a speaker device 1005 according to a specific embodiment of the present invention. FIG. 13 is a sectional perspective view of the speaker device 100S shown in FIG. 12. FIG. 14 is a top view of a substantial part of the speaker device 100S shown in FIG. 12. FIG. 15 is a top view of a substantial part of the speaker device 100S shown in FIG. 12. Hereinafter, the same symbols are applied to the same parts described in the above-mentioned embodiments and the same descriptions are not repeated here. In FIGS. 14 and 15, the diaphragm is not shown. In FIG. 13, a part of the magnetic circuit (right side of the drawing) is omitted.

The speaker device 100S includes a diaphragm 2, a frame 3, an edge 5, a magnetic circuits 40, a voice coil supporting part 6, a vibration-direction-conversion part 7, and a damper (restraint part) 8, as described in the above-mentioned embodiments. In this specific embodiment, the frame 3 has a rectangular periphery, and the planar diaphragm 2 is arranged in a rectangular opening 30 of the frame 3, having a rectangular periphery corresponding to the shape of the opening. The edge 5 is provided at the outer periphery of the diaphragm 2 and the whole outer periphery of the diaphragm 2 is supported by the outer periphery of the frame 3 through the edge 5.

A pair of the voice coil supporting parts 6 driven by a pair of the magnetic circuits 40(R) and 40(L) include both ends in the vibration direction and the vibration-direction-conversion parts 7 are arranged at the both ends of the voice coil supporting part 6. In this specific embodiment, a pair of first link parts 70(R) and 70(L) and a pair of second link parts 71(R) and 71(L) are provided at the center, and the outside link parts 72(R) and 72(L) are provided outside of each voice coil supporting part 6.

The first link parts 70(R) and 70(L) are foldably joined to the center portion (gravity center) of the diaphragm 2 through a hinge part 70B. On the other hand, the outside link parts 72(R) and 72(L) are foldably joined to the diaphragm 2 at the sides of the periphery with respect to the center portion (gravity center) of the diaphragm 2 through hinge parts 72B(R) and 72B(L).

In addition, connecting ends 75 are formed near the upper ends of the first link parts 70(R) and 70(L) and the outside link parts 72(R) and 72(L), and the connecting ends 75 are fitted in grooves 21 formed in the diaphragm 2. Further, for example, the connecting end 75 is fixed in a state projecting from the front surface of the diaphragm 2. This diaphragm 2 is configured to be supported in a line shape by the vibration-direction-conversion parts 7 at three locations. The connecting end 75 is embedded inside the diaphragm 2 as a reinforcing material, thus having a comparatively large strength, thereby suppressing occurrence of deflection of the diaphragm and so on. Accordingly the whole diaphragm 2 can be vibrated substantially in the similar phase.

The first link parts 70(R) and 70(L) and the outside link parts 72(R) and 72(L) forming two opposing parallel links, connecting parts at three locations vibrate substantially in the same phase and substantially with the same amplitude corresponding to the opposing vibrations of the voice coil supporting parts 6 (a plurality of the voice coil supporting parts 6 vibrate in the mutually opposite directions). Therefore, the whole diaphragm 2 is vibrated substantially in the same phase, thereby enabling to suppress occurrence of the divided vibration.

The first link parts 70(R) and 70(L) and the outside link parts 72(R) and 72(L) have vent holes 70P and 72P. Provided with these vent holes 70P and 72P, each link part made of the plate member can be vibrated without receiving significant air resistance. In addition, provided with these vent holes 70P and 72P, each of the link parts can be made light in weight, thus enabling to broaden the bandwidth of a reproduction characteristic.

A restraining element for restraining the moving direction of the voice coil supporting part 6 includes a damper 8 and a supporting part 8A. The supporting part 8A is, for example, an L-shaped member formed in a longitudinal direction along both ends of the voice coil supporting part 6, and supports voice coil supporting part 6 in the longitudinal direction. The end of the supporting part 8A is vibratably supported by the frame 3 through the damper 8. That is, each voice coil supporting part 6 is restrained to be movable only along the X-axis direction by the restraint element. Also, the damper 8 is formed in a damper shape, substantially symmetrically with respect to an axis parallel to the Y-axis that runs between the two magnetic circuits 40(R) and 40(L). Specifically, the damper 8 is formed to be convex in a direction away from this axis.

Further, in this specific embodiment, a vent hole 301 is formed on a side part of the frame 3, enabling air flow in and out of the frame 3. Thereby, a damping force caused by air pressure inside the frame 3 corresponding to the vibration of the diaphragm 2 can be suppressed, thus securely vibrating the diaphragm 2 with a small driving force.

Figure 16:
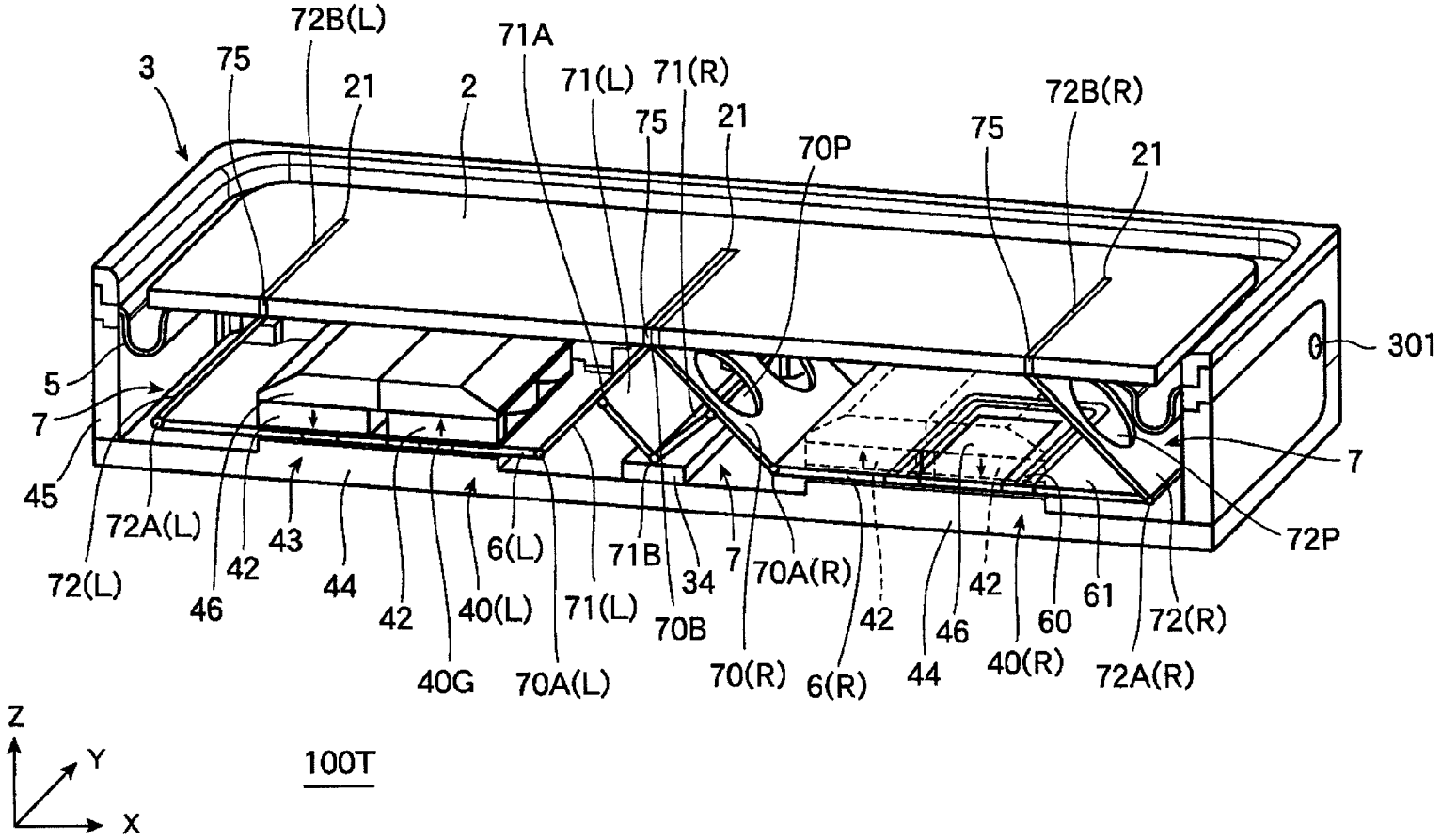
FIG. 16 is a perspective view illustrating another specific embodiment of the present invention.

FIG. 16 is a perspective view of the speaker device 100T according to another specific embodiment of the present invention. The sectional perspective view of the speaker device 100T shown in FIG. 16 and the top view of the substantial parts of the speaker device 100T shown in FIG. 16 are not shown since they are substantially same except that the frame of FIGS. 14 and 15 is a yoke. Hereinafter, the same symbols are applied to the same parts described in the above-mentioned embodiments and a part of the description is not repeated. A part of the magnetic circuit (the right side of the drawing) is omitted.

The speaker device 100T of this embodiment includes a diaphragm 2, a yoke 41A, an edge 5, a magnetic circuit 40, a voice coil supporting part 6, a vibration-direction-conversion part 7, and a damper (restraint part) 8, as described in the above-mentioned embodiments. In this specific embodiment, the yoke 43 has a rectangular periphery, and the planar diaphragm 2 is arranged in a rectangular opening 30 of the yoke 43, having a rectangular periphery corresponding to the shape of the opening. The edge 5 is provided along the outer periphery of the diaphragm 2 and the whole outer periphery of the diaphragm 2 is supported by the outer periphery of the yoke 43 through the edge 5.

The yoke 43 is a stationary part that is arranged to be stationary with respect to the voice coil supporting part. The yoke 43 constituting a driving part 4 includes a bottom plate part 44 arranged under a magnet 42 or a plate 46 and a tubular part 45 formed to surround the bottom plate part 44. The yoke 43 as the stationary part is not necessary to be completely stationary and may be stationary enough, for example to support the diaphragm 2, thus the vibration caused by the driving of the speaker device 100T may transmit to generate a vibration in the whole stationary part.

A pair of the voice coil supporting parts 6 driven by a pair of the magnetic circuits 40(R) and 40(L) includes both ends in the vibration direction. The vibration-direction-conversion parts 7 are arranged at the both ends of the voice coil supporting part 6. In this specific embodiment, a pair of first link parts 70(R) and 70(L) and a pair of second link parts 71(R) and 71(L) are provided at the center, and the outside link parts 72(R) and 72(L) are provided outside of each voice coil supporting part 6.

The first link parts 70(R) and 70(L) are foldably joined to the center portion (gravity center) of the diaphragm 2 through a hinge part 70B. On the other hand, the outside link parts 72(R) and 72(L) are foldably joined to the diaphragm 2 at the side of the outer periphery with respect to the center portion (gravity center) of the diaphragm 2 through hinge parts 72B (R) and 72B(L).

In addition, connecting ends 75 are formed near the upper ends of the first link parts 70(R) and 70(L) and the outside link parts 72(R) and 72(L), and the connecting ends 75 are fitted in grooves 21 formed in the diaphragm 2. Further, for example, the connecting ends 75 are fixed in a state projecting from the front surface of the diaphragm 2. This diaphragm 2 is configured to be supported in a line shape by the vibration-direction-conversion parts 7 at three locations. The connecting end 75 in the line shape is embedded inside the diaphragm 2 as the reinforcing material, thus having a comparatively large strength, thereby suppressing occurrence of the deflection of the diaphragm and so on. Accordingly, the whole diaphragm 2 can be vibrated substantially in the same phase.

The first link parts 70(R) and 70(L) and the outside link parts 72(R) and 72(L) forming two opposing parallel links, connecting parts at three locations vibrate substantially in the same phase and substantially with the same amplitude corresponding to the opposing vibrations of the voice coil supporting parts 6 (a plurality of the voice coil supporting parts 6 vibrate in the mutually opposite directions). Therefore, the whole diaphragm 2 is vibrated as a whole substantially in the same phase, thereby enabling to suppress occurrence of the divided vibration.

The first link parts 70(R) and 70(L) and the outside link parts 72(R) and 72(L) has vent holes 70P and 72P. Provided with these vent holes, each link part made of the plate member can be vibrated without receiving significant air resistance. In addition, provided with these vent holes, each of the link parts can be made to be light in weight, thus enabling to broaden bandwidth of a reproduction characteristic and so on.

The second link parts 71(R) and 71(L) have a hinge part 71A to the middle portion of first link part 70 at one end, while it has a hinge part 71B to a yoke 44 at the other end. The second link parts 71(R) and 71(L) are obliquely arranged in different directions with respect to the vibration direction (for example, X-axis direction) of the voice coil supporting part 6.

Further, the frame 3 in the embodiment shown in FIG. 2(*b*) may be replaced by yoke 43 and the hinge part 71B may be formed on a supporting part 34 (stationary part) protrudingly from a bottom plate part 44 of the yoke 43.

A link body is formed by the first link part 70, the second link part 71, the hinge parts 70A, 70B, 71A and 71B as shown in FIG. 16. In this embodiment, the hinge part 71B between the second link part 71 and the yoke 43 is a hinge part whose position is not displaced, while other hinge parts 70A, 70B, 71A are hinge parts whose positions are displaced. Accordingly, the whole link body has a structure to receive a reaction force from the yoke 43 at the hinge part 71B. In this link body, when the hinge part 70A moves in the X-axis direction according to the vibration of the voice coil supporting part 6, the hinge part 71A moves in the Z-axis direction, thereby the vibration of the voice coil supporting part 6 is direction-converted and transmitted to the diaphragm 2.

The restraining element for restraining the moving direction of the voice coil supporting part 6 includes a damper 8 and a supporting part 8A. The supporting part 8A is, for example, an L-shaped member formed in a longitudinal direction along both ends of the voice coil supporting part 6, and supports the voice coil supporting part 6 in the longitudinal direction. The end of the supporting part 8A is vibratably supported by yoke 43 through the damper 8. That is, each voice coil supporting part 6 is restrained to be movable only in the X-axis direction by the restraint element. Also, the damper 8 is formed in a damper shape, substantially symmetrically with respect to an axis parallel to the Y-axis that runs between the two magnetic circuits 40(R) and 40(L). Specifically, the damper 8 is formed to be convex in a direction away from this axis.

Further, in this specific embodiment, a vent hole 301 is provided on a side part of the yoke 43, enabling air flow in and out of the yoke 43. Thereby, a damping force caused by air pressure inside the yoke 43 corresponding to the vibration of the diaphragm 2 can be suppressed, thus ensuring to vibrate the diaphragm 2 with a small driving force.

Figure 17:
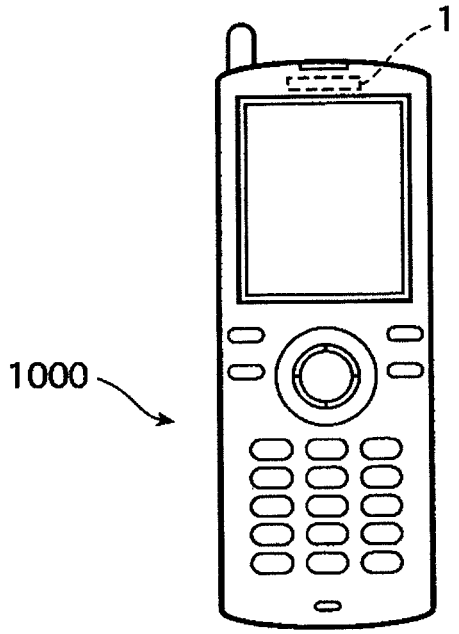
FIG. 17(*a*) and FIG. 17(*b*) are views illustrating electronic devices including the speaker device according to an embodiment of the present invention.
Figure 17:
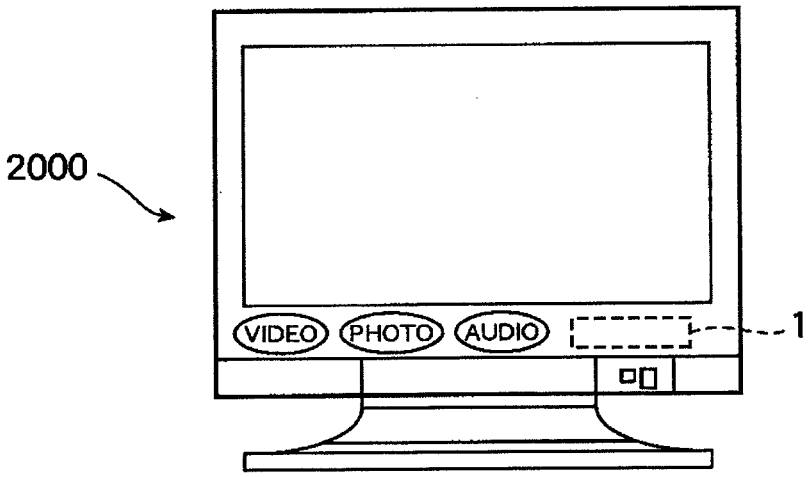
Figure 18:
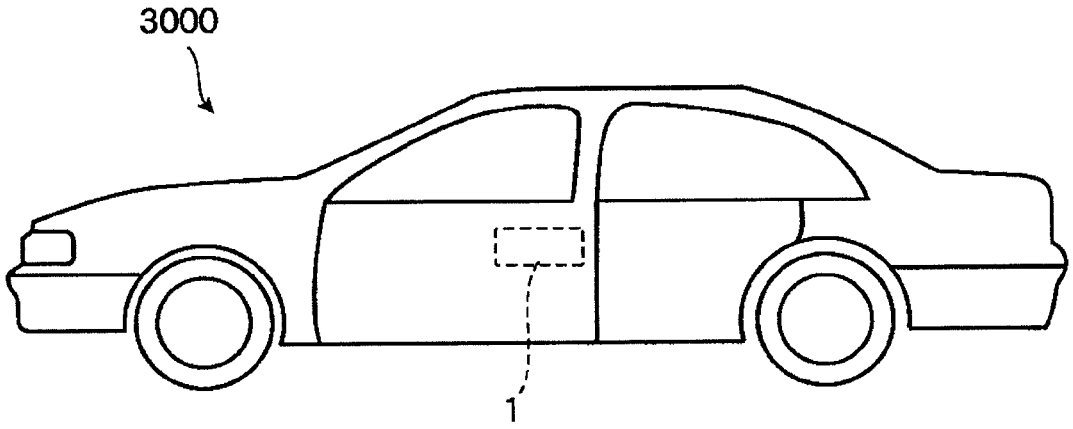
FIG. 18 is a view illustrating a car including the speaker device according to an embodiment of the present invention.

As described above, the speaker device according to the embodiments of the present invention can be made to be thin and capable of producing a large volume of sound. Such a speaker device can be effectively used for various types of electronic devices and in-vehicle devices. FIG. 17 are views illustrating electronic devices including the speaker device according to an embodiment of the present invention. An electronic device 1000 such as a mobile phone or a hand held terminal as shown in FIG. 17(*a*) or an electronic device 2000 such as a flat panel display as shown in FIG. 17(*b*) can be configured to reduce a necessary space in thickness for installing the speaker device 1, which enables to reduce the thickness of the whole electronic device. Also, the electronic devices are capable of producing sufficient audio output. FIG. 18 is a view illustrating a car including the speaker device according to an embodiment of the present invention. A car 3000 as shown in the drawing is capable of increasing its in-car space by using the thin speaker device 1. Particularly with a door panel incorporating the speaker device 1 according to the embodiment of the present invention, driver's operation space can be increased by getting rid of a bulge of a door panel. Further, it is possible to comfortably enjoy music or radio broadcasting in the car even during a noisy high-speed driving due to enabling to produce the sufficient audio output.

The invention claimed is:

1. A speaker device comprising:

a diaphragm;

a frame supporting the diaphragm vibratably in a vibration direction with a first axis; and a driving part disposed in proximity of the frame and vibrating the diaphragm corresponding to an audio signal, wherein the driving part includes:

a magnetic circuit having a magnetic gap;

a voice coil supporting part having a voice coil and vibrating in a direction with a second axis different from the vibration direction of the diaphragm with the first axis; and a vibration-direction-conversion part direction-converting the vibration in the direction with the second axis of the voice coil supporting part and transmitting the vibration in the direction with the first axis to the diaphragm, wherein the vibration-direction-conversion part includes link parts angle-converting one another formed between the voice coil supporting part and the diaphragm.

2. The speaker device according to claim 1, wherein the link body angle-converts the link part with a reaction force from a stationary part disposed opposite to the diaphragm side.

3. The speaker device according to claim 2, wherein the stationary part is a part of the frame.

4. The speaker device according to claim 3, wherein the frame includes a planar bottom face, the diaphragm is planarly supported along the bottom face of the frame, the magnetic gap is formed along the bottom face of the frame, and the vibration-direction-conversion part vibrates the diaphragm in a direction of crossing the bottom face with the reaction force from the bottom face of the frame.

5. The speaker device according to claim 4, wherein the magnetic circuit includes a pair of the magnetic gaps, directions of magnetic fields in the magnetic gaps is mutually opposite, and the voice coil supporting part is planarly formed and includes the voice coil annularly formed such that current flows in opposite directions in the pair of the magnetic gaps.

6. The speaker device according to claim 5, wherein a pair of the driving parts is provided, and the vibration-direction-conversion parts are arranged opposite to each other.

7. The speaker device according to claim 6, wherein the link body of the vibration-direction-conversion part includes a parallel link formed by the link parts.

8. The speaker device according to claim 7, wherein the vibration-direction-conversion part includes:

a first link part having a hinge part to the voice coil supporting part at one end and a hinge part to the diaphragm at the other end; and a second link part having a hinge part to a middle portion of the first link part at one end and a hinge part to the frame at the other end, wherein the first link part and the second link part are obliquely arranged in different directions with respect to the vibration direction of the voice coil supporting part.

9. The speaker device according to claim 8, wherein the vibration-direction-conversion part includes the parallel link formed with the link parts of the vibration-direction-conversion part, and the link parts is arranged on both ends of the voice coil supporting part in the vibration direction.

10. The speaker device according to claim 8, wherein a pair of the driving parts is provided, the vibration-direction-conversion parts are arranged opposite to each other, wherein a hinge part between the first link part in first driving part of the driving parts and the diaphragm and a hinge part between the first link part in second driving part of the driving parts and the diaphragm are formed as a common part or distantly arranged, and a hinge part between the second link part in the first driving part and the frame and a hinge part between the second link part in the second driving part and the frame are formed as a common part or distantly arranged.

11. The speaker device according to claim 8, wherein the vibration-direction-conversion part is formed with a plate member including a line-shaped folding part and the folding part is the hinge part.

12. The speaker device according to claim 11, wherein the vibration-direction-conversion part includes an integral part with a plurality of the plate members, wherein the plate members connect through the folding parts.

13. The speaker device according to claim 1, wherein the vibration-direction-conversion part includes:

a first link part having a hinge part to the voice coil supporting part at one end and a hinge part to the diaphragm at the other end, a second link part having a hinge part to a middle portion of the first link part at one end and a hinge part to the frame at the other end, a third link part integrally extending from the voice coil supporting part or being a part of the voice coil supporting part, a fourth link part fixed along the diaphragm or being a part of the diaphragm, and a fifth link part having a hinge part to an end of the third link part at one end and a hinge part to the fourth link part at the other end, wherein the first link part and the fifth link part form a parallel link, and the third link part and the fourth link part form a parallel link.

14. The speaker device according to claim 1, wherein a pair of the driving parts is provided, the vibration-direction-conversion parts are arranged opposite to each other, wherein the vibration-direction-conversion part includes:

a pair of first link parts having a hinge part to the voice coil supporting part at one end and a hinge part to the diaphragm at the other end, a pair of second link parts having a hinge part to the middle portion of the first link part at one end and a hinge part to the frame at the other end, a pair of third link parts integrally extending from the voice coil supporting part, a fourth link part fixed along the diaphragm, and a pair of fifth link parts having a hinge part to an end of the third link part at one end and a hinge part to the fourth link part at the other end, wherein hinge parts between the first link part and the diaphragm are formed at both ends of the fourth link part, hinge parts between the second link part and the frame are formed at both ends of a sixth link part, and the first link part and the fifth link part form a parallel link, and the third link part and the fourth link part form a parallel link.

15. The speaker device according to claim 14, wherein the vibration-direction-conversion part is formed with a plate member having a folding part as the hinge part and the first link part and the fourth link part are formed with the plate member folded wholly in a convex-trapezoid shape, and the second link part and the sixth link part are formed with a part of the plate member cut out and folded in a concave-trapezoid shape.

16. The speaker device according to claim 14, wherein the vibration-direction-conversion part is formed with two plate members attached to each other, the first link part, the second link part, the fourth link part and the sixth link part are formed with one plate member, the third link part and the fifth link part are formed with the other plate member along the first link part and the fourth link part, and an opening corresponding to the second link part and the sixth link part is formed.

17. The speaker device according to claim 1, further comprising a vibration-restraint part, wherein the diaphragm is supported by the frame through an edge, the driving part includes a magnet and a yoke, and the vibration-restraint part supports the voice coil supporting part movably in the vibration direction and restrains a movement of the voice coil supporting part in a direction other than the vibration direction.

18. The speaker device according to claim 17, wherein a thickness of the vibration-restraint part in the vibration direction is larger than a thickness of the vibration-restraint part in a direction substantially perpendicular to the vibration direction, and a cross-sectional shape of the vibration-restraint part in a direction substantially perpendicular to the vibration direction is formed in a curved line.

19. The speaker device according to claim 1, wherein a slant surface is formed on an end of the link part.

20. The speaker device according to claim 1, wherein the vibration-direction-conversion part includes:

a first link part having a first hinge part to the voice coil supporting part at one end and a second hinge part to the diaphragm at the other end, and a second link part having a third hinge part to the middle portion of the first link part at one end and a fourth hinge part to the frame at the other end, wherein the first hinge part, the second hinge part and the fourth hinge part lie on the circumference of a circle having a center at the third hinge part and having a diameter substantially same as the length of the first link part.

21. The speaker device according to claim 1, wherein the vibration-direction-conversion part includes the link part having rigidity.

22. A car comprising the speaker device according to claim 1.

23. An electronic device comprising the speaker device according to claim 1.

24. A speaker device comprising:

a diaphragm;

a frame supporting the diaphragm vibratably in a vibration direction with a first axis; and a driving part disposed in the frame and vibrating the diaphragm corresponding to an audio signal, wherein the driving part includes:

a magnetic circuit having a magnetic gap;

a voice coil supporting part having a voice coil and vibrating in a direction with a second axis different from the vibration direction of the diaphragm with the first axis; and a vibration-direction-conversion part direction-converting the vibration in the direction with the second axis of the voice coil supporting part and transmitting the vibration in the direction with the first axis to the diaphragm, wherein the vibration-direction-conversion part includes a link part formed between the voice coil supporting part and the diaphragm; and the link part is angle-converted with a reaction force from a stationary part disposed opposite to the diaphragm side.

25. The speaker device according to claim 24, wherein the stationary part is a part of the frame.

26. The speaker device according to claim 25, wherein
the frame includes a planar bottom face,
the diaphragm is planarly supported along the bottom face of the frame,
the magnetic gap is formed along the bottom face of the frame, and
the vibration-direction-conversion part vibrates the diaphragm in a direction of crossing the bottom face with the reaction force from the bottom face of the frame.

27. The speaker device according to claim 26, wherein
the magnetic circuit includes a pair of the magnetic gaps,
directions of magnetic fields in the magnetic gaps is mutually opposite, and
the voice coil supporting part is planarly formed and includes the voice coil annularly formed such that current flows in opposite directions in the pair of the magnetic gaps.

28. The speaker device according to claim 27, wherein
a pair of the driving parts is provided, and
the vibration-direction-conversion parts are arranged opposite to each other.

29. The speaker device according to claim 28, wherein the vibration-direction-conversion part includes a parallel link formed by the link parts.

30. The speaker device according to claim 29, wherein
the vibration-direction-conversion part includes:
a first link part having a hinge part to the voice coil supporting part at one end and a hinge part to the diaphragm at the other end; and
a second link part having a hinge part to a middle portion of the first link part at one end and a hinge part to the frame at the other end, wherein
the first link part and the second link part are obliquely arranged in different directions with respect to the vibration direction of the voice coil supporting part.

31. The speaker device according to claim 30, wherein
a pair of the driving parts is provided, the vibration-direction-conversion parts are arranged opposite to each other, wherein
a hinge part between the first link part in first driving part of the driving parts and the diaphragm and a hinge part between the first link part in second driving part of the driving parts and the diaphragm are formed as a common part and are distantly arranged, and
a hinge part between the second link part in the first driving part and the frame and a hinge part between the second link part in the second driving part and the frame are formed as a common part and are distantly arranged.

32. The speaker device according to claim 30, wherein the vibration-direction-conversion part is formed with a plate member including a line-shaped folding part and the folding part is the hinge part.

33. The speaker device according to claim 24, wherein
the vibration-direction-conversion part includes:
a first link part having a hinge part to the voice coil supporting part at one end and a hinge part to the diaphragm at the other end,
a second link part having a hinge part to a middle portion of the first link part at one end and a hinge part to the frame at the other end,
a third link part integrally extending from the voice coil supporting part or being a part of the voice coil supporting part,
a fourth link part fixed along the diaphragm or being a part of the diaphragm, and
a fifth link part having a hinge part to an end of the third link part at one end and a hinge part to the fourth link part at the other end, wherein
the first link part and the fifth link part form a parallel link, and
the third link part and the fourth link part form a parallel link.

34. The speaker device according to claim 24, wherein
a pair of the driving parts are provided, the vibration-direction-conversion parts are arranged opposite to each other, wherein
the vibration-direction-conversion part includes:
a pair of first link parts having a hinge part to the voice coil supporting part at one end and a hinge part to the diaphragm at the other end,
a pair of second link parts having a hinge part to the middle portion of the first link part at one end and a hinge part to the frame at the other end,
a pair of third link parts integrally extending from the voice coil supporting part,
a fourth link part fixed along the diaphragm, and
a pair of fifth link parts having a hinge part to an end of the third link part at one end and a hinge part to the fourth link part at the other end, wherein
hinge parts between the first link part and the diaphragm are formed at both ends of the fourth link part,
hinge parts between the second link part and the frame are formed at both ends of a sixth link part,
the first link part and the fifth link part form a parallel link, and
the third link part and the fourth link part form a parallel link.

35. The speaker device according to claim 24, comprising a vibration-restraint part, wherein
the diaphragm is supported by the frame through an edge,
the driving part includes a magnet and a yoke, and
the vibration-restraint part supports the voice coil supporting part movably in the vibration direction and restrains a movement of the voice coil supporting part in a direction other than the vibration direction.

36. The speaker device according to claim 24, wherein a slant surface is formed on an end of the link part.

37. The speaker device according to claim 24, wherein
the vibration-direction-conversion part includes:
a first link part having a first hinge part to the voice coil supporting part at one end and a second hinge part to the diaphragm at the other end, and
a second link part having a third hinge part to the middle portion of the first link part at one end and a fourth hinge part to the frame at the other end, wherein
the first hinge part, the second hinge part and the fourth hinge part lie on the circumference of a circle having a center at the third hinge part and having a diameter substantially same as the length of the first link part.

38. The speaker device according to claim 24, wherein the vibration-direction-conversion part includes the link part having rigidity.

39. A car comprising the speaker device according to claim 24.

40. An electronic device comprising the speaker device according to claim 24.

41. A speaker device comprising:
a diaphragm;
a frame supporting the diaphragm in a vibration direction with a first axis; and
a driving part disposed in the frame and vibrating the diaphragm corresponding to an audio signal, wherein the driving part includes:

a magnetic circuit having a magnetic gap;

a voice coil supporting part having a voice coil and vibrating in a direction with a second axis different from the vibration direction of the diaphragm with the first axis; and a rigid vibration-direction-conversion part, one end of which is bendably joined to the voice coil supporting part, another end of a second link part is bendably joined to the diaphragm, and which is obliquely disposed with respect to each of the vibration direction with the second axis of the diaphragm and the moving direction with the first axis of the voice coil supporting part.

* * * * *